US009806446B2

(12) United States Patent
Lee et al.

(10) Patent No.: US 9,806,446 B2
(45) Date of Patent: Oct. 31, 2017

(54) INTERPOSERS HAVING THREE HOUSINGS INTERCONNECTED TO EACH OTHER

(71) Applicant: Apple Inc., Cupertino, CA (US)

(72) Inventors: Jae Hwang Lee, San Jose, CA (US); Mahmoud R. Amini, Sunnyvale, CA (US); Zheng Gao, San Jose, CA (US); Nathan N. Ng, Fremont, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 15/168,036

(22) Filed: May 28, 2016

(65) Prior Publication Data

US 2016/0276765 A1 Sep. 22, 2016

Related U.S. Application Data

(63) Continuation of application No. 14/641,353, filed on Mar. 7, 2015, now Pat. No. 9,356,370, which is a (Continued)

(51) Int. Cl.
*H01R 12/00* (2006.01)
*H01R 12/71* (2011.01)

(Continued)

(52) U.S. Cl.
CPC ..... *H01R 12/71* (2013.01); *H01R 9/096* (2013.01); *H01R 12/52* (2013.01); *H01R 12/724* (2013.01);

(Continued)

(58) Field of Classification Search
CPC ..... H01R 9/096; H01R 12/00; H01R 12/52; H01R 12/71; H01R 12/724;

(Continued)

(56) References Cited

U.S. PATENT DOCUMENTS 3,128,138 A 4/1964 Noschese
3,587,029 A 6/1971 Knowles (Continued)

FOREIGN PATENT DOCUMENTS

CN 101882726 11/2010
CN 101908679 12/2010

(Continued)

OTHER PUBLICATIONS

Final Office Action, U.S. Appl. No. 14/543,711 , dated Mar. 28, 2016, 9 pages.

(Continued)

*Primary Examiner* — Chandrika Prasad
(74) *Attorney, Agent, or Firm* — Kilpatrick Townsend & Stockton LLP

(57) ABSTRACT

Connecting structures to mechanically connect to a connector receptacle tongue and a printed circuit board and to electrically connect contacts on the connector receptacle tongue to traces on the printed circuit board. One example may provide an interposer having a housing and a plurality of contacts to connect a vertical tongue to a horizontal printed circuit board. The contacts may have a side or tongue connecting portion extending beyond a side of the housing and a bottom or board contacting portion extending beyond a bottom of the housing. The contacts may form a ninety-degree bend. A shield may at least substantially surround a vertical side of the housing.

20 Claims, 24 Drawing Sheets

Related U.S. Application Data continuation-in-part of application No. 14/543,768, filed on Nov. 17, 2014, now Pat. No. 9,276,340.

(60) Provisional application No. 62/003,022, filed on May 26, 2014.

(51) Int. Cl.

| | |
|---|---|
| ***H01R 24/66*** | (2011.01) |
| ***H01R 31/06*** | (2006.01) |
| ***H01R 12/52*** | (2011.01) |
| ***H01R 12/72*** | (2011.01) |
| ***H01R 13/04*** | (2006.01) |
| ***H01R 13/658*** | (2011.01) |

(52) U.S. Cl.
CPC ..... *H01R 13/04* (2013.01); *H01R 13/658* (2013.01); *H01R 24/66* (2013.01); *H01R 31/06* (2013.01); *H01R 2201/06* (2013.01)

(58) Field of Classification Search
CPC .. H01R 12/7076; H01R 13/04; H01R 13/658; H01R 13/2414; H01R 13/2435; H01R 24/66; H01R 24/54; H01R 25/00; H01R 27/00; H01R 31/00; H01R 31/06; H01R 33/88; H01R 33/94; H01R 2201/06
USPC ..... 439/66, 300, 638
See application file for complete search history.

(56) References Cited

U.S. PATENT DOCUMENTS

| | | | |
|---|---|---|---|
| 4,337,989 | A | 7/1982 | Landis et al. |
| 4,389,080 | A | 6/1983 | Clark et al. |
| 4,544,227 | A | 10/1985 | Hirose |
| 4,571,012 | A | 2/1986 | Bassler et al. |
| 4,684,192 | A | 8/1987 | Long et al. |
| 4,808,118 | A | 2/1989 | Wilson et al. |
| 4,875,881 | A | 10/1989 | Caveny et al. |
| 4,950,184 | A | 8/1990 | Caveney et al. |
| 5,037,315 | A | 8/1991 | Collier et al. |
| 5,145,385 | A | 9/1992 | Takano |
| 5,164,880 | A | 11/1992 | Cronin et al. |
| 5,221,212 | A | 6/1993 | Davis et al. |
| 5,318,452 | A | 6/1994 | Fortuna et al. |
| 5,382,179 | A | 1/1995 | Noschese et al. |
| 5,431,578 | A | 7/1995 | Wayne et al. |
| 5,547,398 | A | 8/1996 | Ichikawa et al. |
| 5,586,911 | A | 12/1996 | Miller et al. |
| 5,591,050 | A | 1/1997 | Sueoka |
| 5,622,522 | A | 4/1997 | Tan et al. |
| 5,674,085 | A | 10/1997 | Davis et al. |
| 5,788,516 | A | 8/1998 | Uggmark |
| 5,913,690 | A | 6/1999 | Dechelette et al. |
| 5,975,935 | A | 11/1999 | Yamaguchi et al. |
| 5,997,349 | A | 12/1999 | Yoshioka |
| 6,019,616 | A | 2/2000 | Yagi et al. |
| 6,039,583 | A | 3/2000 | Korsunsky et al. |
| 6,042,424 | A | 3/2000 | LaCoy et al. |
| 6,162,089 | A | 12/2000 | Jacobson et al. |
| 6,203,333 | B1 | 3/2001 | Medina et al. |
| 6,287,147 | B1 | 9/2001 | Lin |
| 6,338,652 | B1 | 1/2002 | Ko et al. |
| 6,447,311 | B1 | 9/2002 | Hu et al. |
| 6,565,366 | B1 | 5/2003 | Wu et al. |
| 6,685,486 | B1 | 2/2004 | Zhang et al. |
| 6,736,676 | B2 | 5/2004 | Zhang et al. |
| 6,755,689 | B2 | 6/2004 | Ziqiang et al. |
| 6,840,806 | B2 | 1/2005 | Kodama et al. |
| 6,913,485 | B2 | 7/2005 | Ko et al. |
| 6,926,557 | B1 | 8/2005 | Yamaguchi et al. |
| 6,981,887 | B1 | 1/2006 | Mese et al. |
| 7,052,287 | B1 | 5/2006 | Ni et al. |
| 7,074,052 | B1 | 7/2006 | Ni et al. |
| 7,086,889 | B2 | 8/2006 | Yin et al. |
| 7,086,901 | B2 | 8/2006 | Zhang et al. |
| 7,094,103 | B2 | 8/2006 | Lai et al. |
| 7,128,588 | B2 | 10/2006 | Hu et al. |
| 7,179,124 | B2 | 2/2007 | Zhang et al. |
| 7,207,836 | B2 | 4/2007 | Tsai et al. |
| 7,269,004 | B1 | 9/2007 | Ni et al. |
| 7,314,383 | B1 | 1/2008 | Ho et al. |
| 7,364,464 | B2 | 4/2008 | Shen et al. |
| 7,407,390 | B1 | 8/2008 | Ni |
| 7,445,452 | B1 | 11/2008 | Wu |
| 7,462,071 | B1 | 12/2008 | Wu et al. |
| 7,466,556 | B2 | 12/2008 | Hiew et al. |
| 7,497,737 | B2 | 3/2009 | Mikolajczak et al. |
| 7,604,497 | B2 | 10/2009 | Wu et al. |
| 7,658,617 | B1 | 2/2010 | Brodsky et al. |
| 7,670,156 | B2 | 3/2010 | Chen |
| 7,686,656 | B2 | 3/2010 | He et al. |
| 7,699,663 | B1 | 4/2010 | Little et al. |
| 7,753,724 | B2 | 7/2010 | Gong et al. |
| 7,837,506 | B1 | 11/2010 | Chiang et al. |
| 7,837,510 | B1 | 11/2010 | Hung et al. |
| 7,841,905 | B2 | 11/2010 | He et al. |
| 7,878,852 | B2 | 2/2011 | Hiew et al. |
| 7,883,369 | B1 | 2/2011 | Sun et al. |
| 7,997,909 | B2 | 8/2011 | Xu et al. |
| 8,011,948 | B2 | 9/2011 | Wu et al. |
| 8,011,950 | B2 | 9/2011 | McGrath et al. |
| 8,011,968 | B2 | 9/2011 | Lai et al. |
| 8,047,875 | B2 | 11/2011 | Yamakami et al. |
| 8,052,476 | B2 | 11/2011 | He et al. |
| 8,100,720 | B2 | 1/2012 | Hsu et al. |
| 8,133,061 | B1 | 3/2012 | Ayers, Sr. et al. |
| 8,147,272 | B2 | 4/2012 | Rhein et al. |
| 8,251,747 | B2 | 8/2012 | He et al. |
| 8,298,009 | B2 | 10/2012 | Elkhatib et al. |
| 8,393,907 | B2 | 3/2013 | Lee et al. |
| 8,454,381 | B2 | 6/2013 | Wu et al. |
| 8,475,218 | B2 | 7/2013 | Zheng et al. |
| 8,476,110 | B2 | 7/2013 | Lee et al. |
| 8,506,317 | B2 | 8/2013 | Bandhu et al. |
| 8,545,273 | B1 | 10/2013 | Chen |
| 8,567,050 | B2 | 10/2013 | Abraham et al. |
| 8,579,519 | B2 | 11/2013 | Wu et al. |
| 8,602,822 | B2 | 12/2013 | Siahaan et al. |
| 8,662,933 | B2 | 3/2014 | Wu et al. |
| 8,696,388 | B2 | 4/2014 | Gao et al. |
| 8,708,718 | B2 | 4/2014 | Li et al. |
| 8,708,752 | B2 | 4/2014 | Wu et al. |
| 8,747,147 | B2 | 6/2014 | Yu et al. |
| 8,764,492 | B2 | 7/2014 | Chiang |
| 8,794,981 | B1 | 8/2014 | Hayashida et al. |
| 8,808,029 | B2 | 8/2014 | Castillo et al. |
| 8,808,030 | B2 | 8/2014 | Gao et al. |
| 8,814,443 | B2 | 8/2014 | He et al. |
| 8,814,599 | B2 | 8/2014 | Wu et al. |
| 8,821,181 | B1 | 9/2014 | Loo et al. |
| 8,911,262 | B1 | 12/2014 | Leiba et al. |
| 8,992,249 | B2 | 3/2015 | Sugiyama et al. |
| 9,065,212 | B2 | 6/2015 | Golko et al. |
| 9,065,229 | B2 | 6/2015 | Yamaguchi et al. |
| 9,276,340 | B2 * | 3/2016 | Amini ..... H01R 12/71 |
| 9,281,608 | B2 | 3/2016 | Zhao |
| 9,356,370 | B2 * | 5/2016 | Lee ..... H01R 12/71 |
| 9,496,653 | B2 | 11/2016 | Little |
| 9,614,310 | B2 * | 4/2017 | Tsai ..... H01R 12/724 |
| 9,660,399 | B2 * | 5/2017 | Hsu ..... H01R 24/60 |
| 2002/0001982 | A1 | 1/2002 | Sakurada et al. |
| 2002/0142636 | A1 | 10/2002 | Murr et al. |
| 2005/0026469 | A1 | 2/2005 | Ice et al. |
| 2006/0052005 | A1 | 3/2006 | Zhang et al. |
| 2007/0072446 | A1 | 3/2007 | Hashimoto et al. |
| 2007/0111600 | A1 | 5/2007 | Tokunaga et al. |
| 2007/0115682 | A1 | 5/2007 | Roberts et al. |
| 2007/0254517 | A1 | 11/2007 | Olson et al. |
| 2009/0023339 | A1 | 1/2009 | Kameyama et al. |
| 2009/0042448 | A1 | 2/2009 | He et al. |
| 2010/0248544 | A1 | 9/2010 | Xu et al. |
| 2010/0267282 | A1 | 10/2010 | Tsai |

(56) References Cited

U.S. PATENT DOCUMENTS

| | | | | |
|---|---|---|---|---|
| 2010/0303421 | A1 | 12/2010 | He et al. | |
| 2011/0151688 | A1 | 6/2011 | Beaman et al. | |
| 2011/0237134 | A1 | 9/2011 | Gao | |
| 2011/0300749 | A1 | 12/2011 | Sytsma et al. | |
| 2012/0015561 | A1 | 1/2012 | Tsai et al. | |
| 2012/0030943 | A1 | 2/2012 | Hiew et al. | |
| 2012/0282808 | A1 | 11/2012 | Luo et al. | |
| 2013/0005193 | A1 | 1/2013 | Tsai et al. | |
| 2013/0045638 | A1 | 2/2013 | Gui et al. | |
| 2013/0122752 | A1 | 5/2013 | Lu et al. | |
| 2013/0164965 | A1 | 6/2013 | Yin et al. | |
| 2013/0183862 | A1 | 7/2013 | Ni et al. | |
| 2013/0217253 | A1 | 8/2013 | Golko et al. | |
| 2013/0244492 | A1 | 9/2013 | Golko et al. | |
| 2013/0288520 | A1 | 10/2013 | Simmel et al. | |
| 2013/0288537 | A1 | 10/2013 | Simmel et al. | |
| 2013/0330976 | A1 | 12/2013 | Simmel et al. | |
| 2014/0024257 | A1 | 1/2014 | Castillo et al. | |
| 2014/0073183 | A1 | 3/2014 | Golko et al. | |
| 2014/0078695 | A1 | 3/2014 | Shih et al. | |
| 2014/0094066 | A1 | 4/2014 | Do | |
| 2014/0113493 | A1 | 4/2014 | Funamura et al. | |
| 2014/0194005 | A1 | 7/2014 | Little et al. | |
| 2014/0220827 | A1 | 8/2014 | Hsu et al. | |
| 2014/0242848 | A1 | 8/2014 | Golko et al. | |
| 2015/0031240 | A1 | 1/2015 | Yang et al. | |
| 2015/0131245 | A1 | 5/2015 | Amini et al. | |
| 2015/0162684 | A1 | 6/2015 | Amini et al. | |
| 2015/0171562 | A1 | 6/2015 | Gao et al. | |
| 2015/0200493 | A1 | 7/2015 | Gao et al. | |
| 2015/0214673 | A1 | 7/2015 | Gao et al. | |
| 2015/0244111 | A1* | 8/2015 | Ju | H01R 13/6585 439/607.05 |
| 2015/0340782 | A1 | 11/2015 | Amini et al. | |
| 2015/0340783 | A1 | 11/2015 | Lee et al. | |
| 2015/0340813 | A1 | 11/2015 | Ng et al. | |
| 2015/0340825 | A1 | 11/2015 | Ng et al. | |

FOREIGN PATENT DOCUMENTS

| | | |
|---|---|---|
| CN | 102341970 | 2/2012 |
| CN | 103140995 | 6/2013 |
| EP | 1085604 | 3/2001 |
| EP | 2228871 | 9/2010 |
| EP | 2590273 | 5/2013 |
| GB | 2067361 | 7/1981 |
| WO | 2011163256 | 12/2011 |
| WO | 2012177905 | 12/2012 |

OTHER PUBLICATIONS

Non-Final Office Action, U.S. Appl. No. 14/543,711, dated Dec. 9, 2015, 15 pages.
Non-Final Office Action, U.S. Appl. No. 14/543,717, dated Nov. 10, 2015, 16 pages.
Notice of Allowance, U.S. Appl. No. 14/543,717 , dated May 25, 2016, 8 pages.
Final Office Action, U.S. Appl. No. 14/543,748, dated Jun. 28, 2016, 21 pages.
Non-Final Office Action, U.S. Appl. No. 14/543,748, dated Nov. 17, 2015, 21 pages.
Notice of Allowance, U.S. Appl. No. 14/543,768 , dated Oct. 14, 2015, 9 pages.
Non-Final Office Action, U.S. Appl. No. 14/543,803 , dated Jan. 4, 2016, 14 pages.
Notice of Allowance, U.S. Appl. No. 14/543,803 , dated Jun. 27, 2016, 7 pages.
Restriction Requirement, U.S. Appl. No. 14/543,803, dated Oct. 8, 2015, 5 pages.
Notice of Allowance, U.S. Appl. No. 14/641,353, dated Jan. 25, 2016, 8 pages.
First Action Interview Pilot Program Pre-Interview Communication, U.S. Appl. No. 14/641,375 , dated May 16, 2016, 7 pages.
Restriction Requirement, U.S. Appl. No. 14/641,375, dated Feb. 16, 2016, 5 pages.
Office Action, Chinese Patent Application No. 201410858208.7, dated Jul. 4, 2016, 19 pages.
Office Action, Chinese Patent Application No. 201420874292.7, dated Mar. 6, 2015, 1 page.
PCT/US2014/065968 , "International Search Report and Written Opinion", Jul. 3, 2015, 17 pages.
PCT/US2014/065968 , "Invitation to Pay Additional Fees and Partial Search Report", Apr. 28, 2015, 6 pages.
PCT/US2014/065996 , "International Search Report and Written Opinion", Jul. 10, 2015, 18 pages.
PCT/US2014/065996 , "Invitation to Pay Add'l Fees and Partial Search Report", May 4, 2015, 6 Pages.
PCT/US2015/010253 , "International Search Report and Written Opinion", Mar. 17, 2015, 12 pages.
Office Action, Taiwan Patent Application No. 103139835, dated Nov. 26, 2015, 4 pages.
Taiwan Office Action (English Translation) mailed Aug. 9, 2016 in TW 103139835, 3 pages.
Office Action dated Aug. 10, 2017 in U.S. Appl. No. 15/368,691, 11 pages.
Notice of Allowance dated Aug. 16, 2017 in U.S. Appl. No. 15/268,645, 10 pages.

* cited by examiner

INTERPOSERS HAVING THREE HOUSINGS INTERCONNECTED TO EACH OTHER

CROSS-REFERENCES TO RELATED APPLICATIONS

This application is a continuation of U.S. patent application Ser. No. 14/641,353 , filed Mar. 7, 2015 , which is a continuation-in-part of U.S. patent application Ser. No. 14/543,768 , filed Nov. 17, 2014 , which claims the benefit of U.S. provisional patent application No. 62/003,022 , filed May 26, 2014 , which are incorporated by reference.

BACKGROUND

The amount of data transferred between electronic devices has grown tremendously the last several years. Large amounts of audio, streaming video, text, and other types of data content are now regularly transferred among desktop and portable computers, media devices, handheld media devices, displays, storage devices, and other types of electronic devices. Power may be transferred with this data, or power may be transferred separately.

Power and data may be conveyed over cables that may include wire conductors, fiber optic cables, or some combination of these or other conductors. Cable assemblies may include a connector insert at each end of a cable, though other cable assemblies may be connected or tethered to an electronic device in a dedicated manner. The connector inserts may be inserted into receptacles in the communicating electronic devices to form pathways for power and data.

These receptacles may include a tongue supporting a number of contacts. The contacts may be electrically connected to traces on the tongue. The traces on the tongue may electrically connect to traces on a printed circuit board or other substrate in the electronic device. Often this may be accomplished by mounting the connector receptacle on the printed circuit board.

But in some devices it may be desirable to locate a receptacle such that its tongue is located at a different height or Z position from the printed circuit board in the electronic device. For example, it may be desirable to position a receptacle at a mid-height level of an electronic device while it may be desirable to locate a board at a lower-height level of the electronic device. It may also be desirable to be able to rotate a position of a connector receptacle relative to a printed circuit board in the electronic device.

Thus, what is needed are interposers and other connecting structures for electrically connecting contacts on a connector receptacle tongue to traces on a printed circuit board.

SUMMARY

Accordingly, embodiments of the present invention may provide interposers and other connecting structures for electrically connecting contacts on a connector receptacle tongue to traces on a printed circuit board where the connector receptacle are at different heights or Z positions or at different angles relative to each other.

Embodiments of the present invention may provide electronic devices that may include one or more connector receptacles. These connector receptacles may each include a tongue supporting a number of contacts. These contacts may electrically connect to traces on or in the tongue. The electronic devices may each have a printed circuit board or other substrate, which may support a number of circuits or components joined by one or more traces. The receptacle tongue and printed circuit board may be at different heights or Z positions in an electronic device and may be formed as separate structures for this reason. In other embodiments the present invention, a tongue may be rotated relative to the printed circuit board. In still other embodiments of the present invention, a tongue and printed circuit board may be separate structures for other reasons. In these situations, embodiments of the present invention may provide an interposer or other connecting structure to connect the receptacle tongue to the printed circuit board. These interposers may provide height or angle translation functions such that a tongue of a receptacle may be connected to a main logic, motherboard, or other appropriate board or substrate.

An illustrative embodiment of the present invention may provide an interposer having a number of through-hole contacts in a housing. The through-hole contacts may be inserted in openings in a tongue and printed circuit board. The amount of the through-hole contacts that are inserted may be varied in order to adjust for variations in height between the tongue and printed circuit board.

Another illustrative embodiment of the present invention may provide an interposer having a number of surface-mount contacts on a top and bottom of a housing. The surface-mount contacts may be soldered to contacts on a tongue and printed circuit board. Surface-mount contacts on a bottom of the interposer may electrically connect to surface-mount contacts on a bottom of the interposer.

Another illustrative embodiment of the present invention may provide an interposer having a housing and a plurality of contacts. The contacts may have a side or tongue connecting portion extending beyond a first side of the housing and a bottom or board contacting portion extending beyond a bottom of the housing. The contacts may form a ninety-degree bend. A shield may at least substantially surround a top, first side, second side, and third side of the housing.

Another illustrative embodiment of the present invention may provide an interconnect structure. The interconnect structure may include a first housing portion forming a tongue for a connector receptacle. A second housing portion may support a first plurality of contacts. The first plurality of contacts may each include at least one tongue contacting portion at a first end to form a contact on a first side of the tongue and a board contacting portion at a second end. A third housing portion may support a second plurality of contacts and the second plurality of contacts may each include at least one tongue contacting portion at a first end to form a contact on a second side of the tongue and a board contacting portion at a second end. The tongue contacting portions of each of the first and second plurality of contacts may be orthogonal to a corresponding board contacting portion. A shield may be formed around at least portions of the first housing, the second housing, and the third housing. At least one of the plurality of first contacts and at least one or the plurality of second contacts may each include two tongue contacting portions and one board contacting portion.

Another illustrative embodiment of the present invention may provide an interconnecting structure including a tongue and a housing, the housing supporting a plurality of contacts for making a right-angle translation. The tongue may be supported by a connecting portion. The tongue and connecting portion may be formed of a printed circuit board. Contacts may be plated on top and bottom sides of the tongue. Additional ground contacts may be located on a top and bottom side of the tongue. The connecting portion may include openings to accept posts on a housing for mechanical stability. The housing may include additional posts for fitting in a second printed circuit board, such as a main logic board, for mechanical stability. The housing may include a number of vertical slots for accepting a plurality of contacts. These contacts may have first contacting portions to fit in openings in the connecting portion and second contacting portions to fit in openings in a printed circuit board. The contacts may further include front testing portions which may be available at a front of the housing for testing and other purposes. A shield may cover a rear, top, left and right sides of the housing. A bottom of housing may be left unshielded such that contacting portions of the contacts may emerge from the bottom housing to fit in openings on the printed circuit board. A front of the housing may be unshielded such that the connecting portion may be attached.

Another illustrative embodiment of the present invention may provide an interposer structure having a plastic tongue. The plastic tongue may include a central ground plane. The central ground plane may be formed by metal injection molding or other process. The tongue may support a number of contacts having a right angle such that the interposer structure provides a 90 degree translation. Some of these contacts may emerge from a bottom of the interposer structure as through-hole contacting portions, while others may emerge as surface-mount contacting portions.

These and other embodiments of the present invention may provide interposers and other connecting structures that provide height, rotational, or both height and rotational translations. These interposers and other connecting structures may mechanically connect a tongue or other connector receptacle portion to a printed circuit board or other appropriate substrate. These interposers and other connecting structures may also electrically connect contacts or traces on the tongue to traces on the printed circuit board or other appropriate substrate.

In various embodiments of the present invention, contacts, shields, and other conductive portions of interposers and other connecting structures may be formed by stamping, metal-injection molding, machining, micro-machining, 3-D printing, or other manufacturing process. The conductive portions may be formed of stainless steel, steel, copper, copper titanium, phosphor bronze, or other material or combination of materials. They may be plated or coated with nickel, gold, or other material. The nonconductive portions, such as the housings and device enclosures, may be formed using injection or other molding, 3-D printing, machining, or other manufacturing process. The nonconductive portions may be formed of silicon or silicone, rubber, hard rubber, plastic, nylon, liquid-crystal polymers (LCPs), or other nonconductive material or combination of materials. The printed circuit boards and tongues used may be formed of FR-4, BT or other material. Printed circuit boards may be replaced by other substrates, such as flexible circuit boards, in many embodiments of the present invention.

Embodiments of the present invention may provide interposes and connecting structures that may be located in, and may connect to, various types of devices, such as portable computing devices, tablet computers, desktop computers, laptops, all-in-one computers, wearable computing devices, cell phones, smart phones, media phones, storage devices, portable media players, navigation systems, monitors, power supplies, adapters, remote control devices, chargers, and other devices. These interposes and connecting structures may provide pathways for signals that are compliant with various standards such as Universal Serial Bus (USB) including USB-C, High-Definition Multimedia Interface® (HDMI), Digital Visual Interface (DVI), Ethernet, DisplayPort, Thunderbolt™, Lightning™, Joint Test Action Group (JTAG), test-access-port (TAP), Directed Automated Random Testing (DART), universal asynchronous receiver/transmitters (UARTs), clock signals, power signals, and other types of standard, non-standard, and proprietary interfaces and combinations thereof that have been developed, are being developed, or will be developed in the future. Other embodiments of the present invention may provide interposes and connecting structures that may be used to provide a reduced set of functions for one or more of these standards. In various embodiments of the present invention, these interconnect paths provided by these interposes and connecting structures may be used to convey power, ground, signals, test points, and other voltage, current, data, or other information.

Various embodiments of the present invention may incorporate one or more of these and the other features described herein. A better understanding of the nature and advantages of the present invention may be gained by reference to the following detailed description and the accompanying drawings.

DESCRIPTION OF ILLUSTRATIVE EMBODIMENTS

Figure 1:
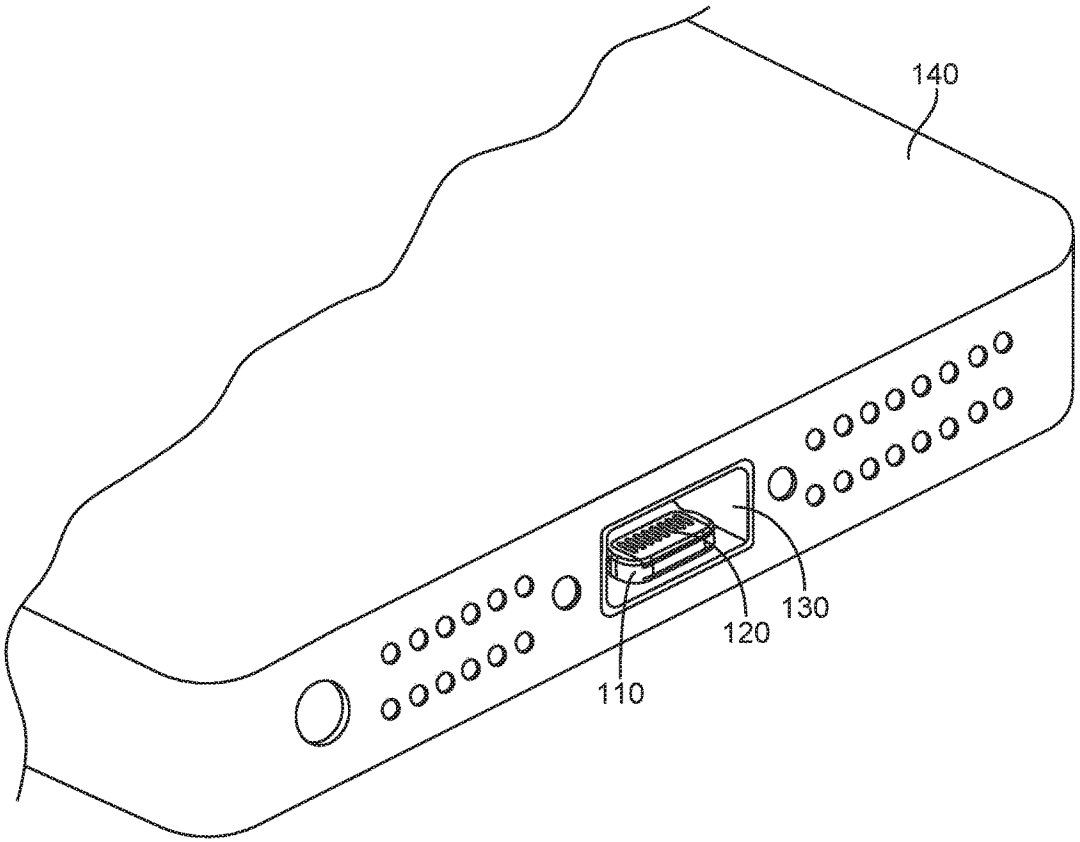
FIG. 1 illustrates an electronic device according to an embodiment of the present invention.

FIG. 1 illustrates an electronic device according to an embodiment of the present invention. This figure, as with the other included figures, is shown for illustrative purposes and does not limit either the possible embodiments of the present invention or the claims. This electronic device may be housed in device enclosure 140. Tongue 110 may be located in an opening 130 in the device enclosure 140. Contacts 120 may be located on tongue 110. Contacts 120 may electrically connect to traces on and in tongue 110. These traces may connect through an interposer or other connecting structure according to an embodiment of the present invention to traces on a printed circuit board in the electronic device.

In various embodiments of the present invention, the tongue and board may be at different heights or at angles relative to each other in an electronic device. In these situations, one or more different typ1es of interposers may be used to connect these boards. A connector receptacle according to an embodiment of the present invention is shown in the following figure.

Figure 2:
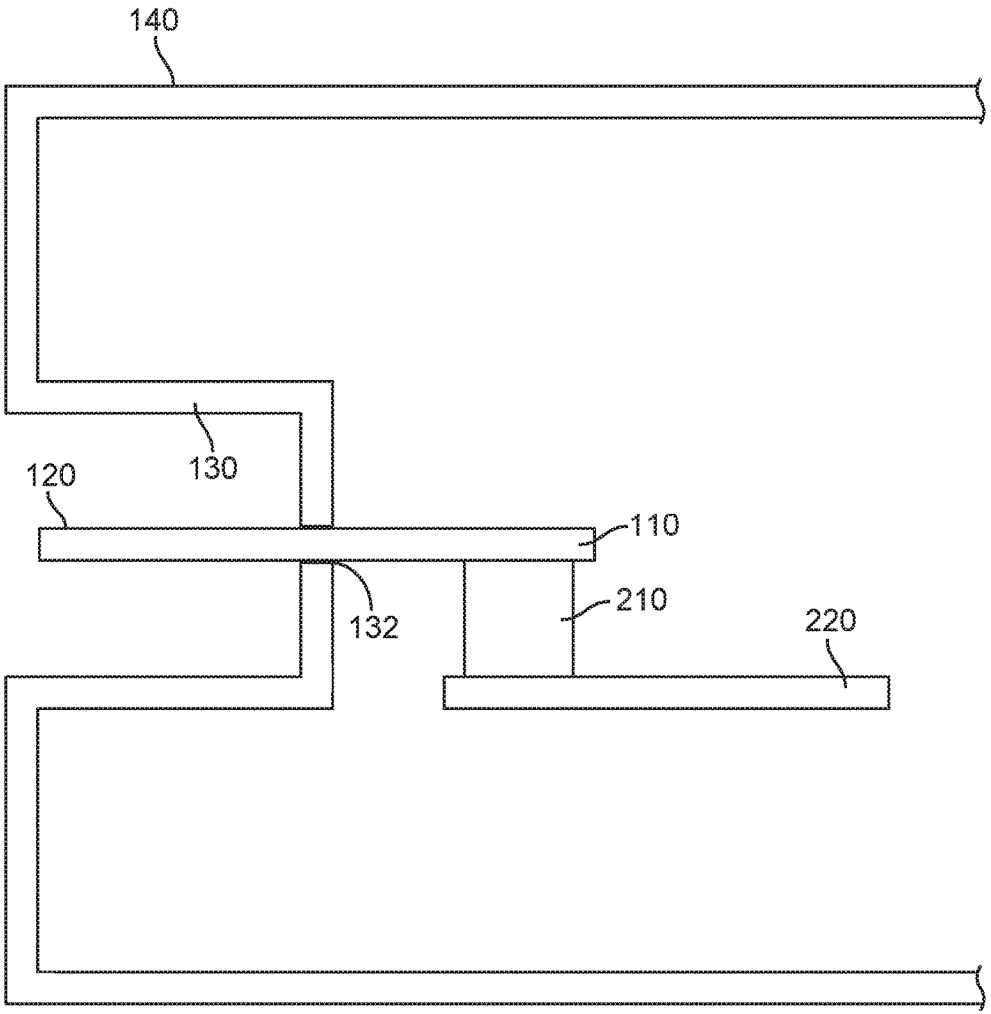
FIG. 2 illustrates a side view of an electronic device according to an embodiment of the present invention.

FIG. 2 illustrates a side view of an electronic device according to an embodiment of the present invention. In this example, tongue 110 may be located in an opening or recess 130 in housing 140. Specifically, tongue 110 may be inserted through passage or opening 132 in opening or recess 130 such that contacts 120 may be mated with corresponding contacts on a connector insert (not shown.) More information on these connector receptacles and tongues may be found in co-pending U.S. patent application Ser. No. 14/543,748, titled "Connector Receptacle Having a Tongue," filed Nov. 17, 2014, which is incorporated by reference.

It may be desirable to connect contacts 120, which may be connected to traces on tongue 110, to traces on printed circuit board 220. However, these to boards may be at different heights or at different angles in the device. Accordingly, interposer 210 or other connecting structure may be used to connect contacts 120 and traces on tongue 110 to traces on printed circuit board 220. Also, while embodiments of the present invention are well-suited to forming electrical connections between tongues and printed circuit boards, embodiments of the present invention may provide interposers and other interconnect structures to form electrical connections between other structures, such as receptacle housings that may support a number of contacts, flexible circuit boards, and other appropriate connector portions and substrates. Examples of specific interposers and connecting structures are shown in the following figures.

Figure 3:
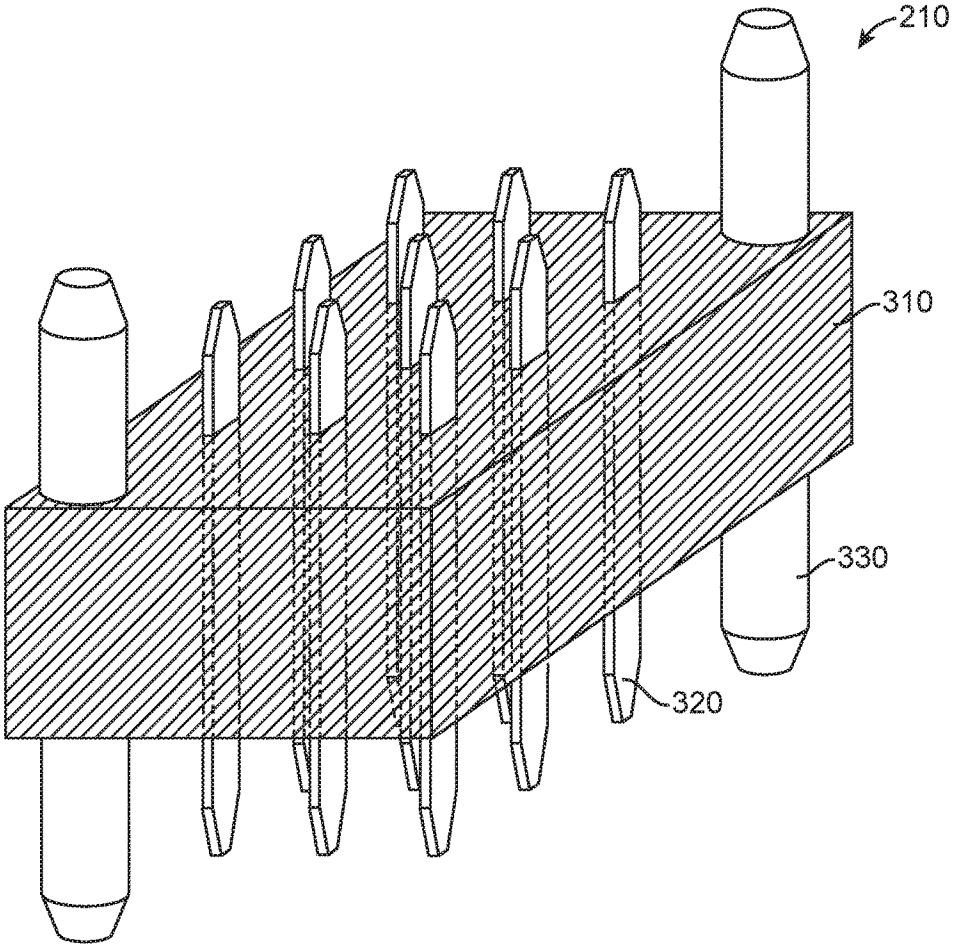
FIG. 3 illustrates an interposer according to an embodiment of the present invention.

FIG. 3 illustrates an interposer according to an embodiment of the present invention. Interposer 210 may include a number of through-hole contacts 320 housed in a housing 310. These through-hole contacts 320 may be placed in openings in a tongue and printed circuit board in an electronic device. That is, through-hole contacts 320 may fit in holes or openings on tongue 110 and board 220 in an electronic device and soldered to form electrical connections with traces connected to the holes or openings. Posts 330 may optionally be included for alignment and mechanical support. Housing 310 may be formed of plastic or other nonconductive material.

Through-hole contacts 320 may help to provide vertical adjustment to the connections between a tongue and a printed circuit board, such as tongue 110 and printed circuit board 220. That is, the contacts 320 may be inserted into openings in the tongue or printed circuit board an amount that varies with the vertical offset, or difference in Z position, between the tongue and printed circuit board. This adjustment may be useful in accounting for variations in positions when interposers are used to connect a tongue and board at different angles relative to each other.

Through-hole contacts, such as through-hole contacts 320, may tend to emit more signal noise thereby degrading signal integrity. This may make these through-hole contacts unsuitable for very high-speed applications. In such applications, surface-mount contacts may be used. These surface-mount contacts may be positioned on either or both ends of contacts, such as contacts 320. These surface-mount contacts may be SMT type contacts, ball contacts, or other types of surface-mount contacts. An example of an interposer using ball contacts is shown in the following figure.

Figure 4:
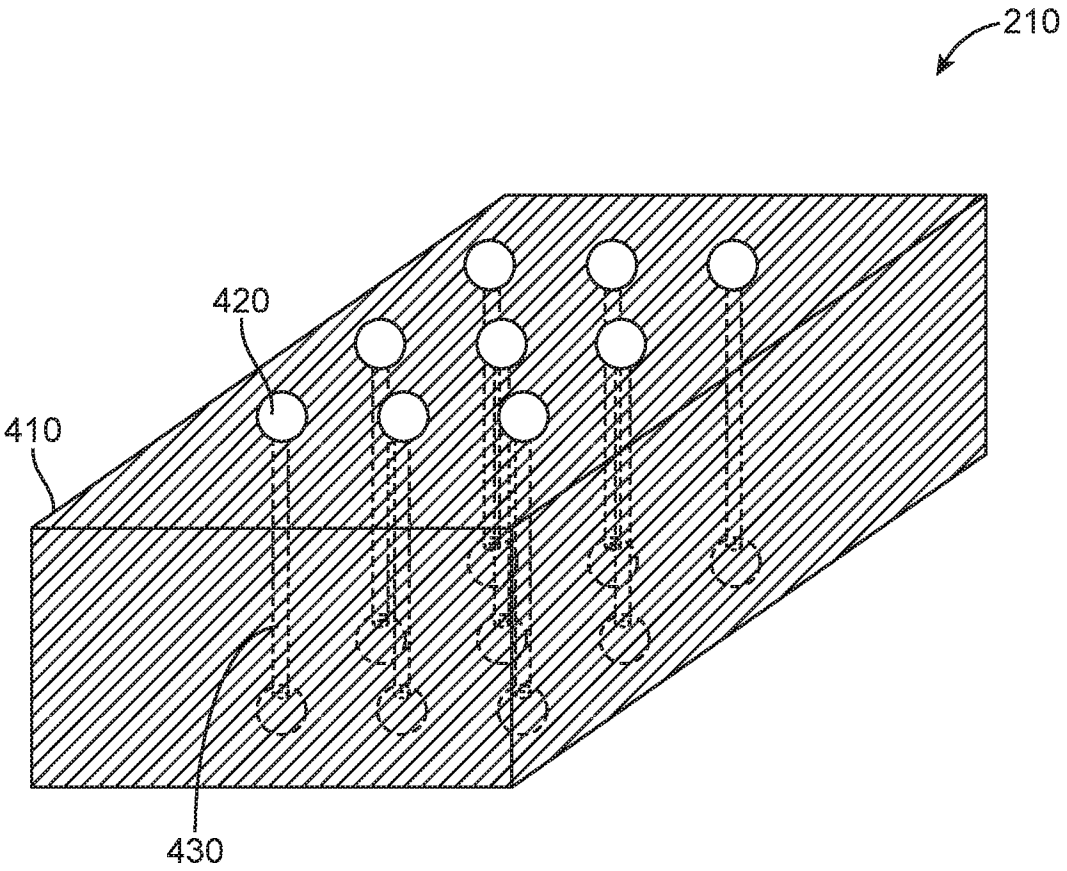
FIG. 4 illustrates another interposer according to an embodiment of the present invention.

FIG. 4 illustrates another interposer according to an embodiment of the present invention. This interposer may include ball grid array contacts 420 on a top and bottom surface of housing 410. These ball grid arrays may be interconnected by pathways 430. The ball grid array contacts may provide surface-mount connections to a tongue and to a printed circuit board.

In various embodiments of the present invention, it may be desirable to attach an interposer to a tongue before attaching the interposer and tongue together as a unit to a printed circuit board. In such case, a higher temperature solder or connecting material may be used to connect the tongue to the interposer. This may ensure that the tongue and interposer remain intact together while the interposer is soldered to the printed circuit board using a lower temperature solder or connecting material.

Figure 5:
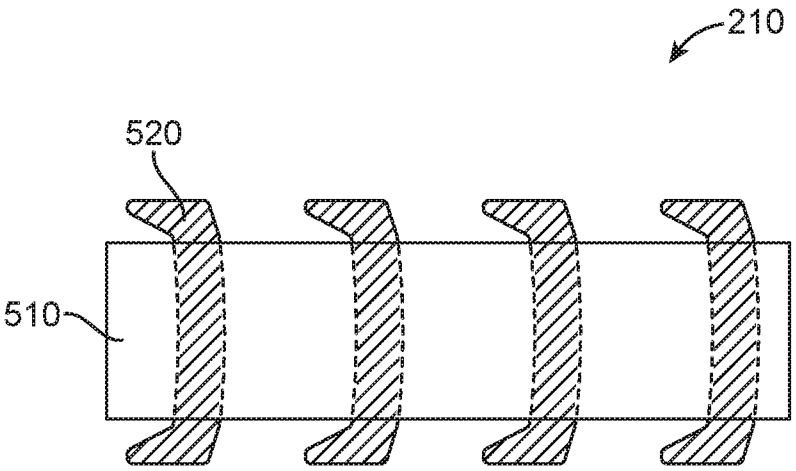
FIG. 5 illustrates another interposer according to an embodiment of the present invention.

FIG. 5 illustrates another interposer according to an embodiment of the present invention. In this example, spring contacts 520 may be located in housing 510 of interposer 210. Spring contacts 520 of interposer 210 may compress and form connections when sandwiched between a tongue and a printed circuit board, such as tongue 110 and printed circuit board 220 in the above example.

Figure 6:
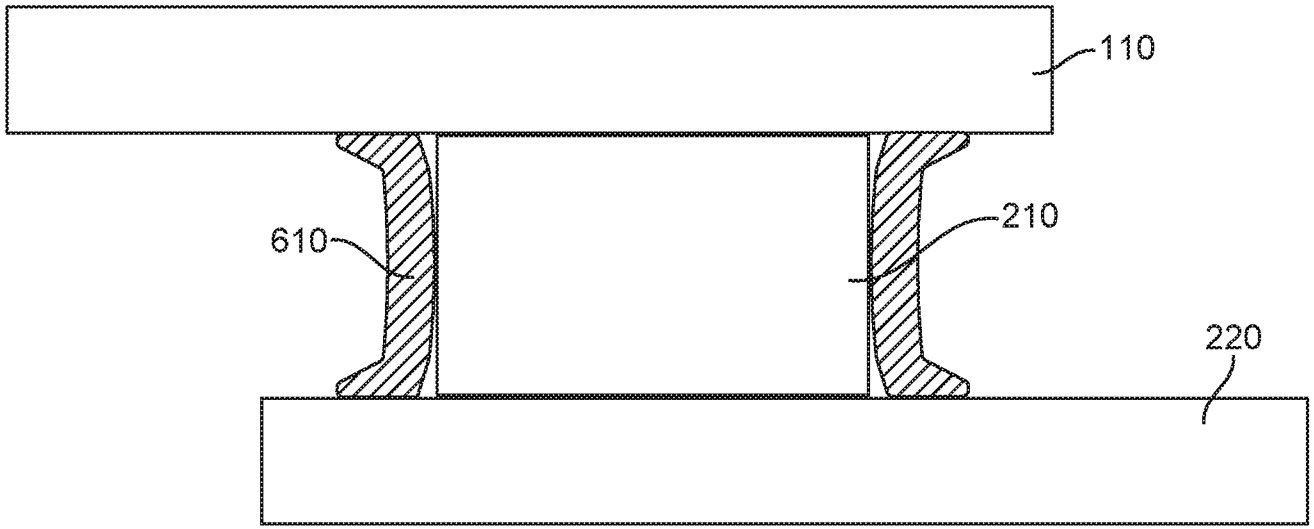
FIG. 6 illustrates a side view of an interposer having a ground shield according to an embodiment of the present invention.

FIG. 6 illustrates a side view of an interposer having a ground shield according to an embodiment of the present invention. In this example, tongue 110 may be connected to printed circuit board 220 through interposer 210. These spring finger arrangement of FIG. 5 may be used to provide ground shields 610. Interposer 210 may be formed as any of the interposers shown here or it may be formed in other ways.

Figure 7:
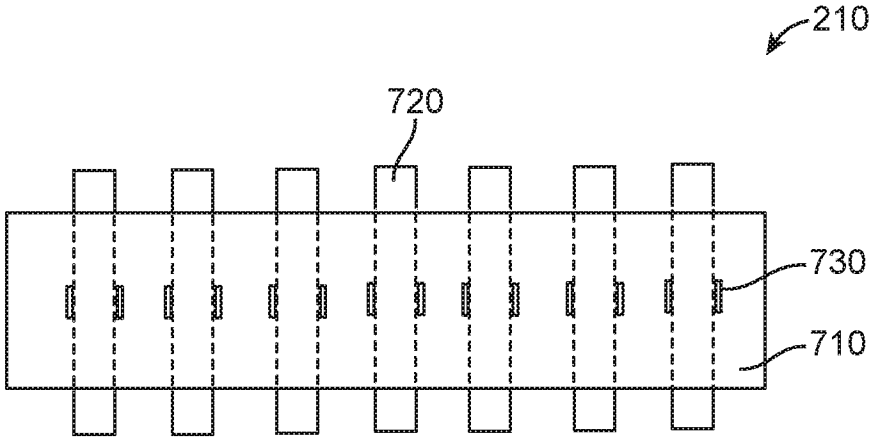
FIG. 7 illustrates another interposer according to an embodiment of the present invention.

FIG. 7 illustrates another interposer according to an embodiment of the present invention. In this embodiment of the present invention, tin bars 720 may be located in nonconductive housing 710 of interposer 210. During soldering, tin bars 4020 may flow forming connections to contacts on a tongue and printed circuit board. Crash bars 730 may be used to secure tin bars 720 in place.

In these embodiments of the present invention, the interposers may provide a height translation. In these and other embodiments of the present invention, interposers may provide an angular translation. Examples are shown in the following figures.

Figure 8:
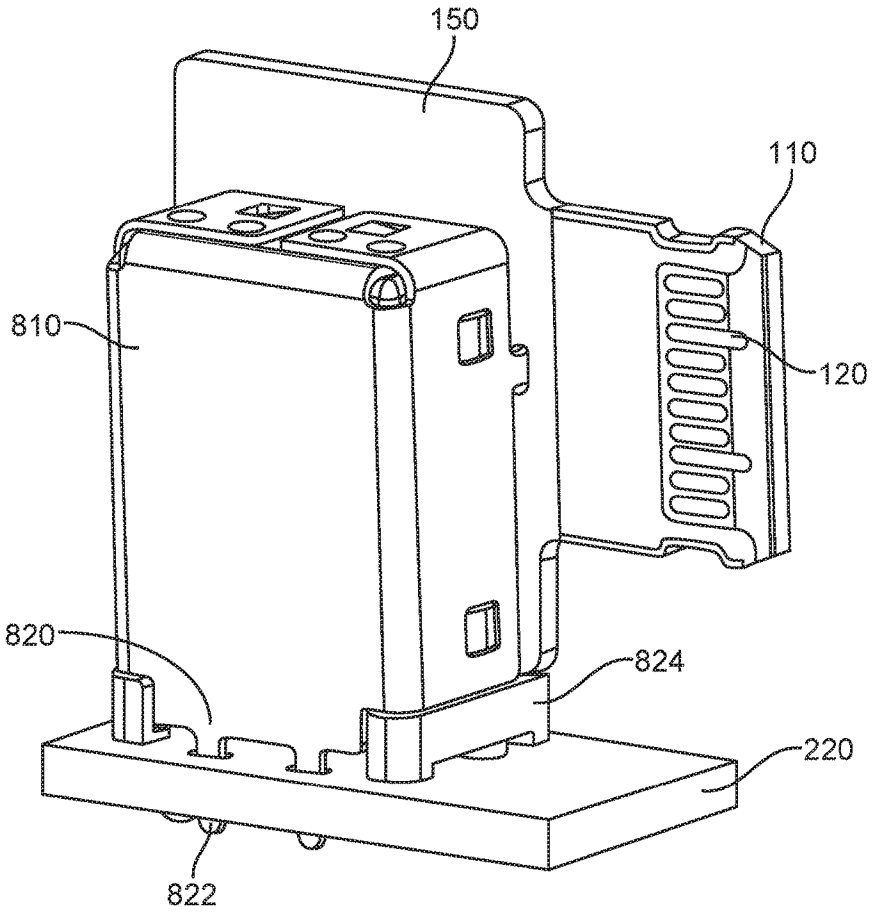
FIG. 8 illustrates an interposer according to an embodiment of the present invention.

FIG. 8 illustrates an interposer according to an embodiment of the present invention. As with the other interposers and connecting structures shown, interposer 810 may physically attach tongue 110 to printed circuit board 220 and interposer 810 may electrically connect traces on or in tongue 110 to traces on or in printed circuit board 220. In this example, tongue 110 may support contacts 120 and may have a connecting portion 150. Tongue 110 and connecting portion 150 may be formed as a printed circuit board or using printed circuit board methods. Interposer 810 may include a shield 820 having tabs 822. Interposer 810 may be supported by support structure 824. Support structure 824 and tabs 822 may be inserted in holes in printed circuit board 220. In this way, interposer 810 may physically attach tongue 110 to printed circuit board or other appropriate substrate 220. In this example, interposer 810 may also provide a 90 degree translation, that is, tongue 110 may be at an angle relative to printed circuit board 220. Interposer 810 may electrically connect traces on or in tongue 110 to traces on or in board 220 through a plurality of contacts. An example is shown in the following figure.

Figure 9:
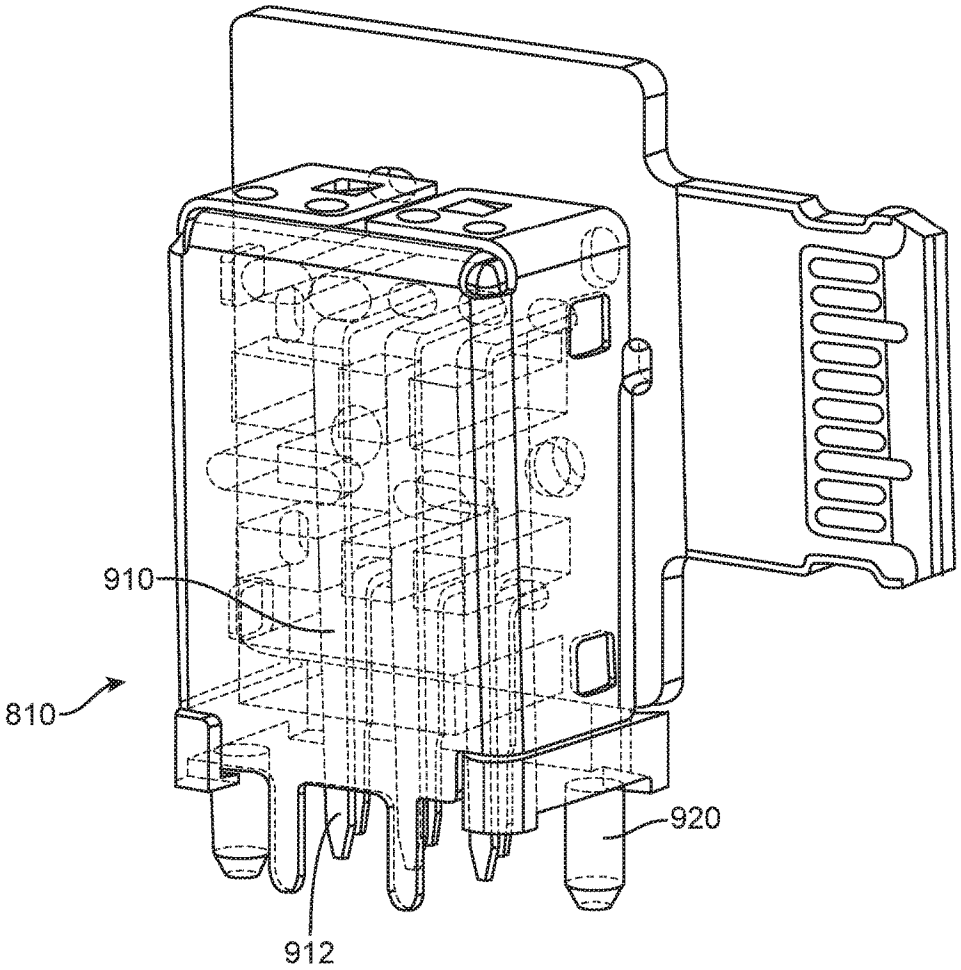
FIG. 9 illustrates a transparent view of the interposer of FIG. 8.

FIG. 9 illustrates a transparent view of the interposer of FIG. 8. In this example, contacts 910 may provide a right-angle translation between traces on a tongue, which may be formed of a printed circuit board, and another printed circuit board. Contacts 910 may include through-hole portions 912. Posts 920 may be used for alignment purposes and mechanical support.

Figure 10:
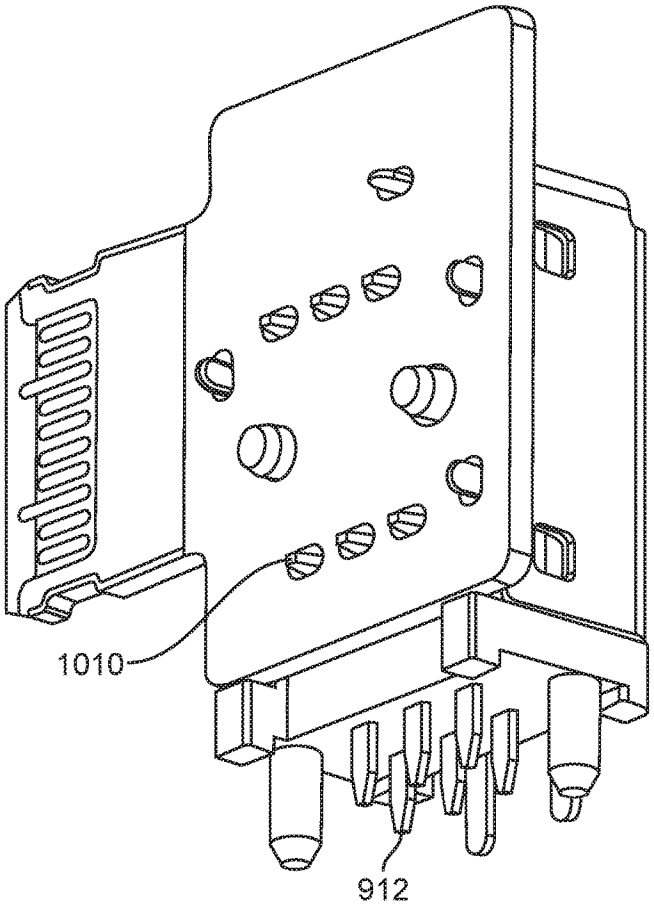
FIG. 10 illustrates a reverse side view of the interposer of FIG. 8.

FIG. 10 illustrates a reverse side view of the interposer of FIG. 8. Again, through-hole contacts 1010 and 912 may be used to join traces between a tongue and printed circuit board, such as tongue 110 and printed circuit board 220.

Figure 11:
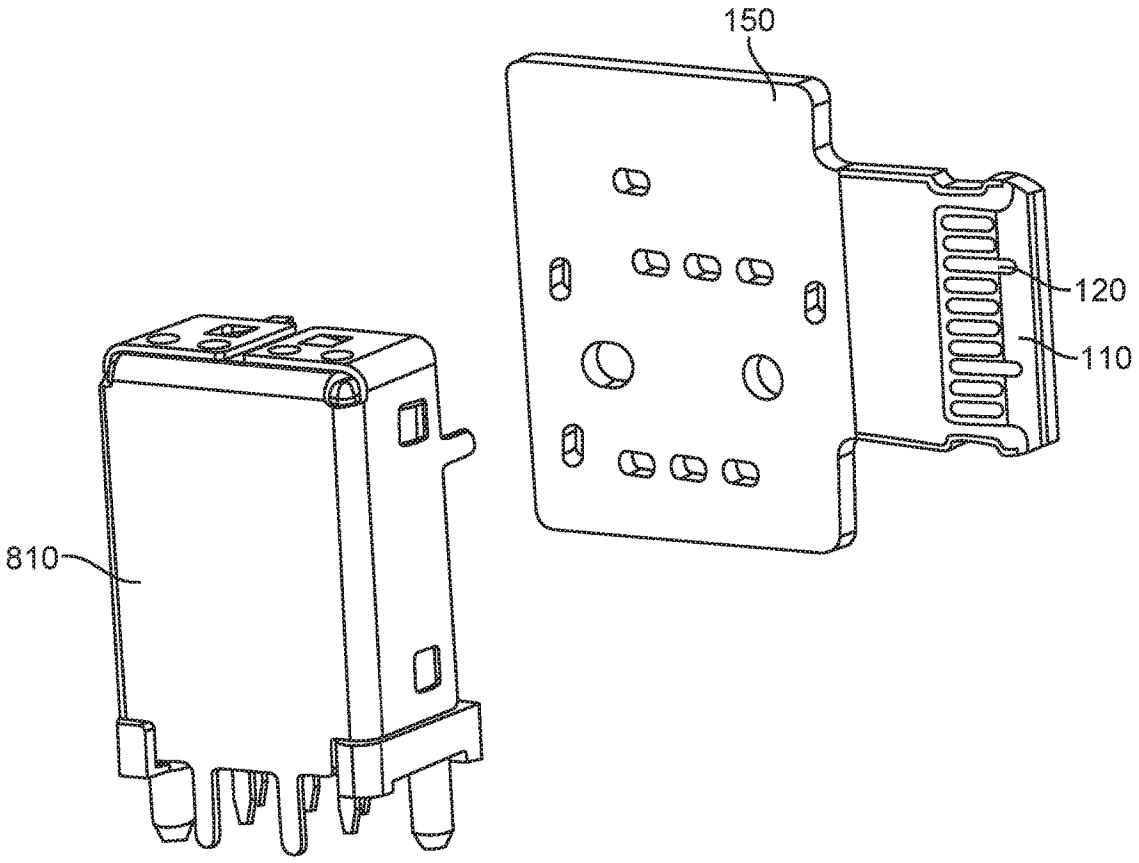
FIG. 11 illustrates an isolated view of a tongue and interposer according to an embodiment of the present invention.

FIG. 11 illustrates an isolated view of a tongue and interposer according to an embodiment of the present invention. Tongue 110 may support contacts 120 and may have a connecting portion 150. Interposer 810 may connect tongue 110 to a printed circuit board 220 (shown in other illustrations.)

Figure 12:
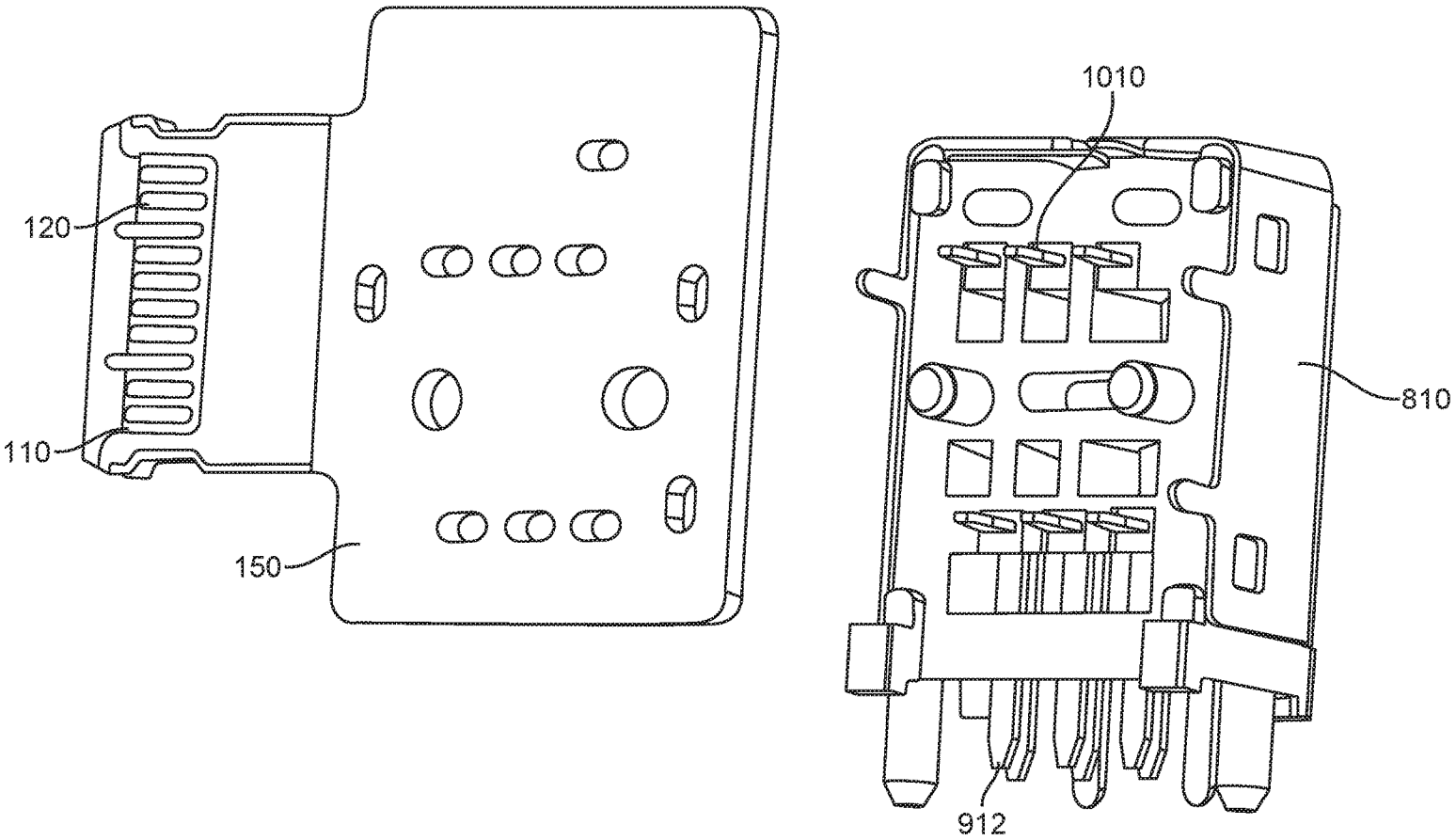
FIG. 12 illustrates another isolated view of a tongue and interposer according to an embodiment of the present invention.

FIG. 12 illustrates another isolated view of a tongue and interposer according to an embodiment of the present invention. Again, tongue 110 may support contacts 120 and may have a contacting portion 150. Interposer 810 may provide a right-angled translation using contacts having through-hole contacting portions 1010 and 912.

In the above example, tongue 110 and connecting portion 150 may be formed as a printed circuit board. In other embodiments of the present invention, a tongue may be formed of plastic or other material. An example is shown in the following figure.

Figure 13:
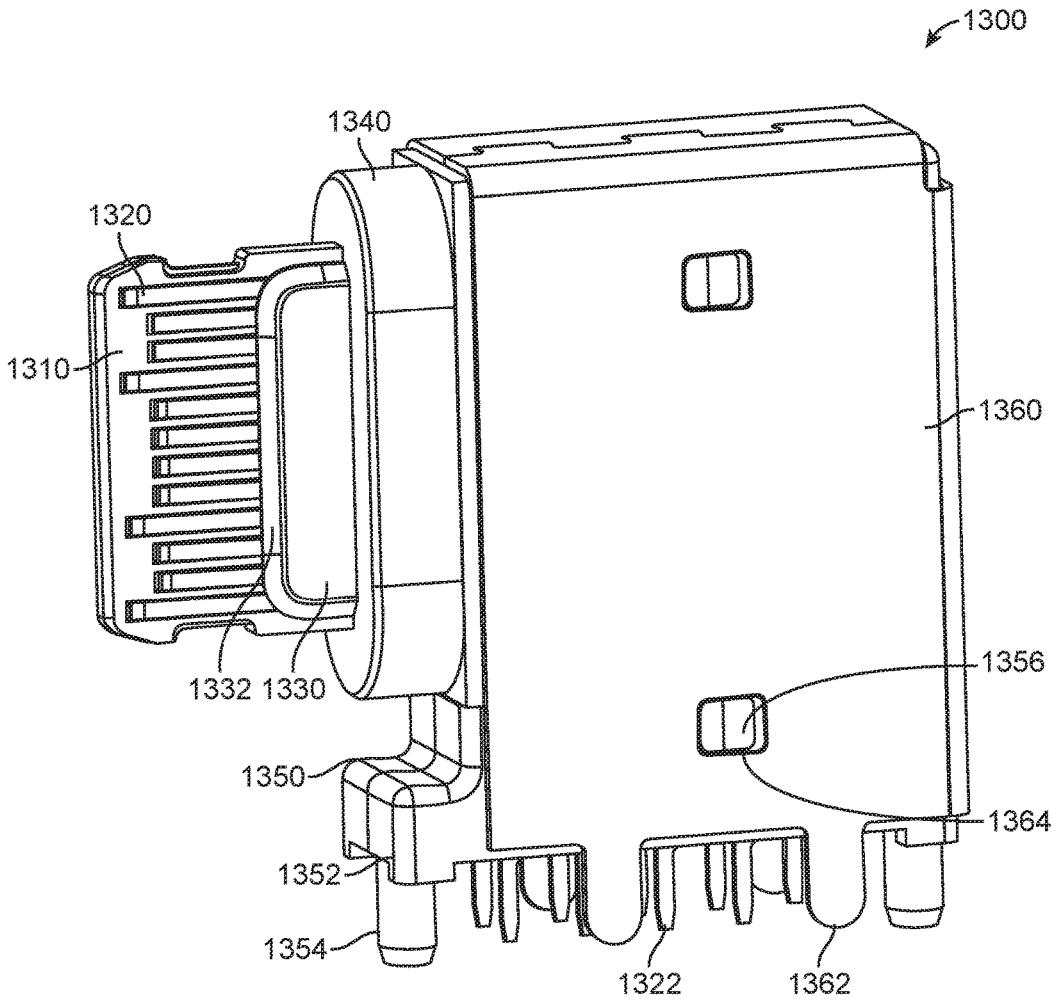
FIG. 13 illustrates another connecting structure according to an embodiment of the present invention.

FIG. 13 illustrates a connecting structure according to an embodiment of the present invention. Connecting structure 1300 may include tongue 1310 supporting a number of contacts 1320 on each side. Tongue 1310 may further include ground contacts 1330 on each side. Ground contacts 1330 may be isolated from contacts 1320 by housing portion 1332. Tongue 1330 and housing portion 1332 may be formed of plastic or other material. Raised portion 1340 may be formed around tongue 1310 and may be arranged to accept an opening on a connector insert, or it may be arranged to fit in an opening in a device enclosure that may house connecting structure 1300. Contacts 1320 may terminate in board contact portions 1322. Board contact portions 1322 may fit in openings in a printed circuit board and may connect to traces in a printed circuit board. Housing portions 1350 and 1352 may support these contacts and may be at least partially surrounded by shield 1360. Shield 1360 may include opening 1364 for accepting tabs 1356 on housing portions 1352 and 1350. Shield 1360 may further include tabs 1362. Tabs 1362 may fit in openings and electrically connect to ground traces or planes in a printed circuit board. Posts 1354 may be inserted in openings in a printed circuit board for alignment and mechanical stability.

Figure 14:
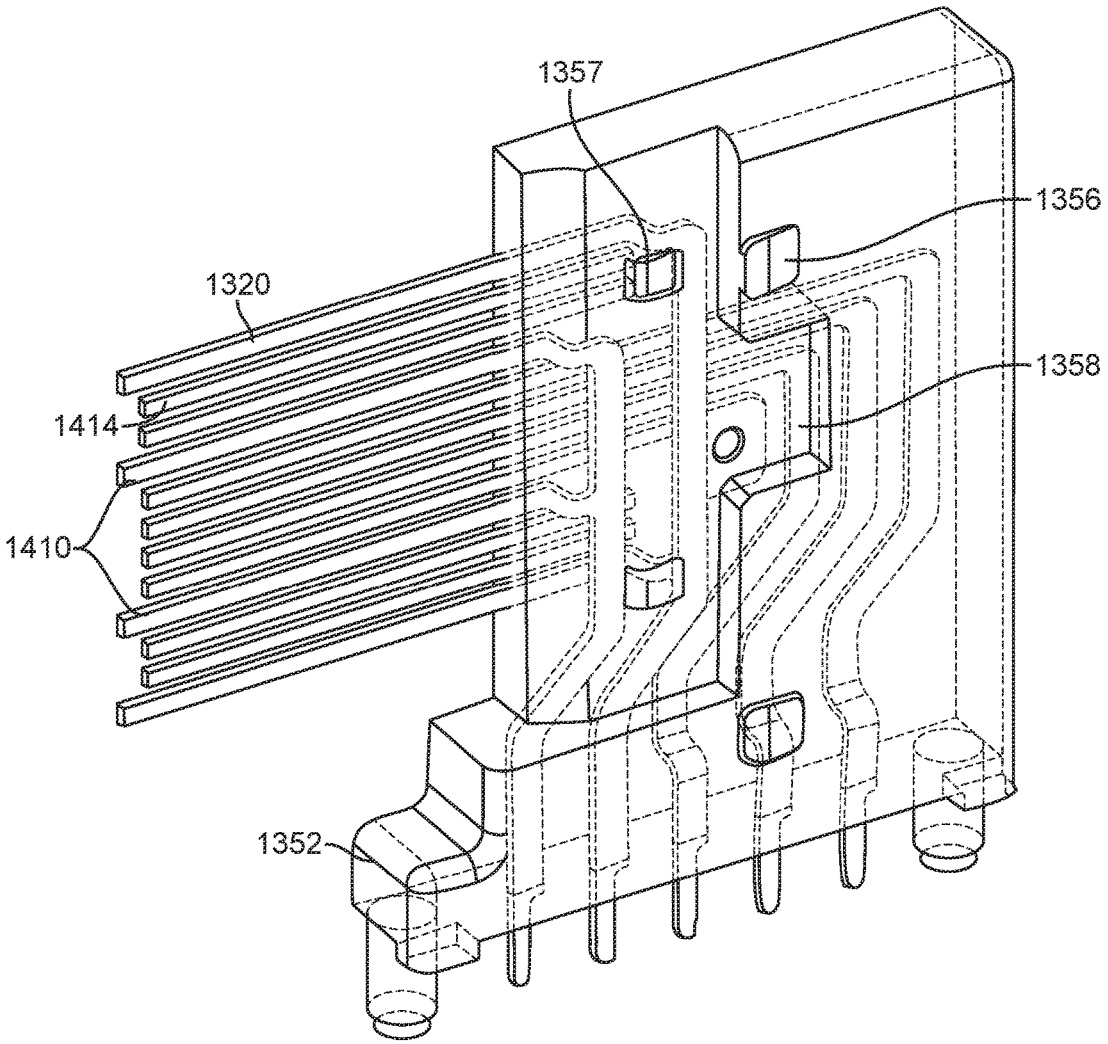
FIG. 14 illustrates a transparent view of two housing portions of the connecting structure of FIG. 13.
Figure 14:
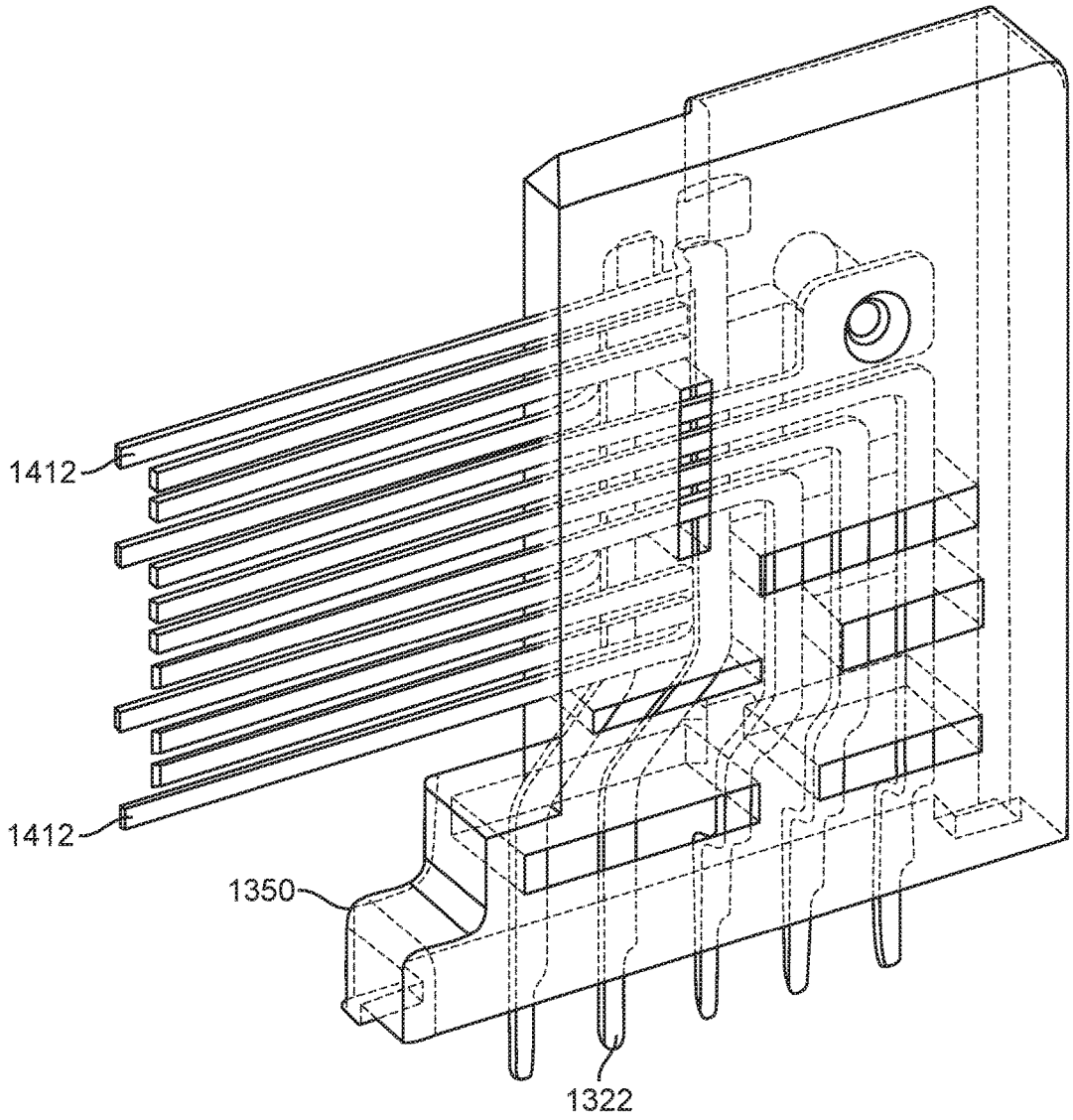

FIG. 14 illustrates contacts and housing portions of the connecting structure of FIG. 13. Housing portion 1352 and housing portion 1350 may each support a number of contacts 1320 that may terminate in board contact portions 1322. Contacts, or tongue contacting portions 1320, may be at least approximately orthogonal to board contacting portions 1322. In this way, contacts 1320 may provide a right angle translation between the tongue and a printed circuit board.

In various embodiments of the present invention, a number of contacts on a tongue may be fixed or determined by an existing interface specification. But it may be desirable to reduce the number of contact portions 1322. Reducing the number of board contact portions 1322 may reduce the board space consumed by connecting structure 1300. Accordingly, in some embodiments of the present invention, more than one tongue contacting portion 1320 may be connected together and connected to a single board contacting portion 1322. For example, tongue contact portions 1410 may electrically connected together. These contact portions may be for power and may connect together to a single power contact portion 1322. Similarly, ground contacts 1412 may be connected together to a single board contact portion 1322. Moreover, other tongue contacts, such as tongue contacting portion 1414, may be present but may not be connected to a board contacting portion 1322.

A third housing portion (not shown) may form tongue 1310. This third housing portion may attach to housing portions 1352 and 1350 using tabs 1357 and notches 1358, as shown below.

Figure 15:
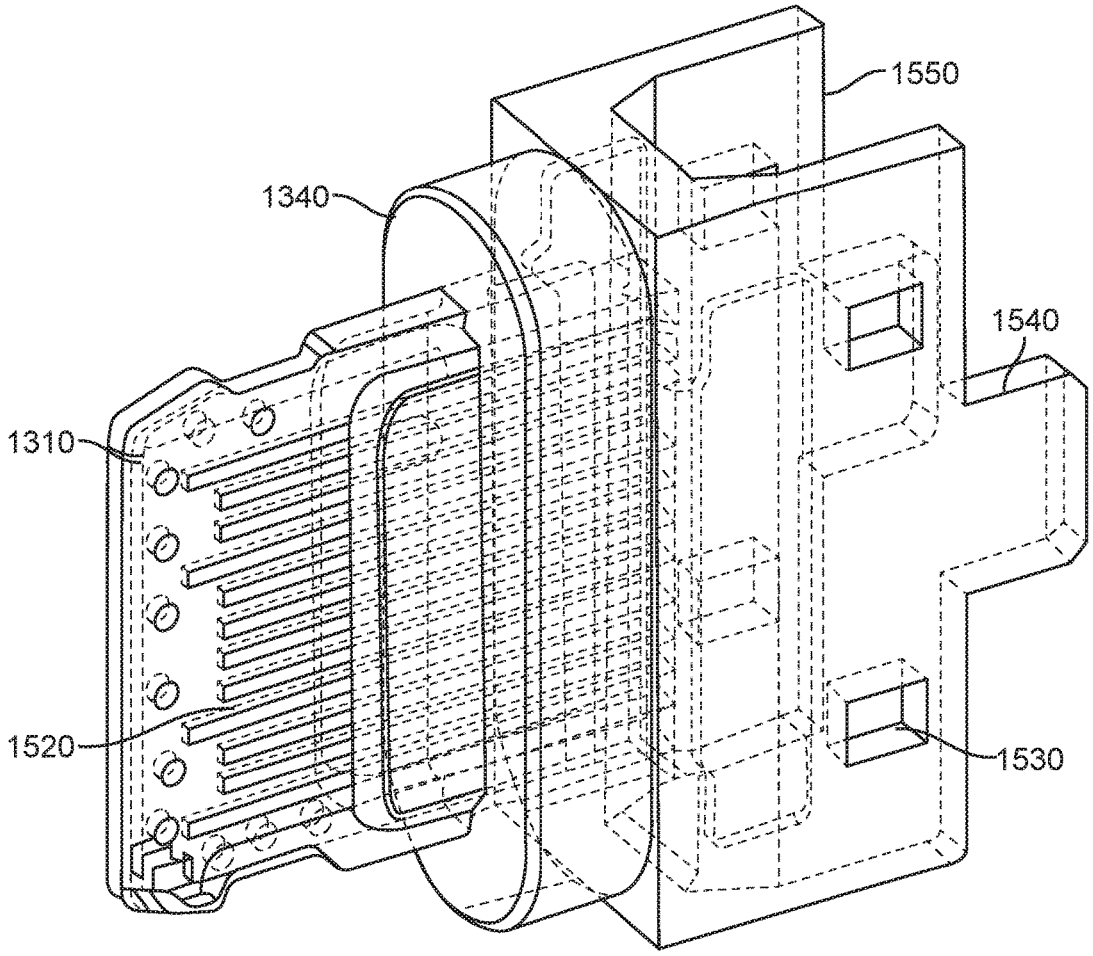
FIG. 15 illustrates a transparent view of another housing portion of the connecting structure of FIG. 13.

FIG. 15 illustrates a housing portion for the connecting structure of FIG. 13. Tongue 1310 may include a number of slots 1520. Tongue contact portions 1320 may reside in slots 1520. Raised portion 1340 may be formed on this housing portion. First and second housing portions 1350 and 1352 may be placed together and inserted into opening 1550. Tabs 1557 on housing portions 1352 and 1350 may fit in openings 1530, while extensions 1540 may fit in notches 1358 in housing portions 1352 and 1350.

Other embodiments of the present invention may include tongues formed of printed circuit boards or plastic. The plastic may be reinforced with a central ground plane, such as a metallic central ground plane, for increased durability. Examples of interposers having a printed circuit board tongue and a plastic tongue are shown in the following figures.

Figure 16:
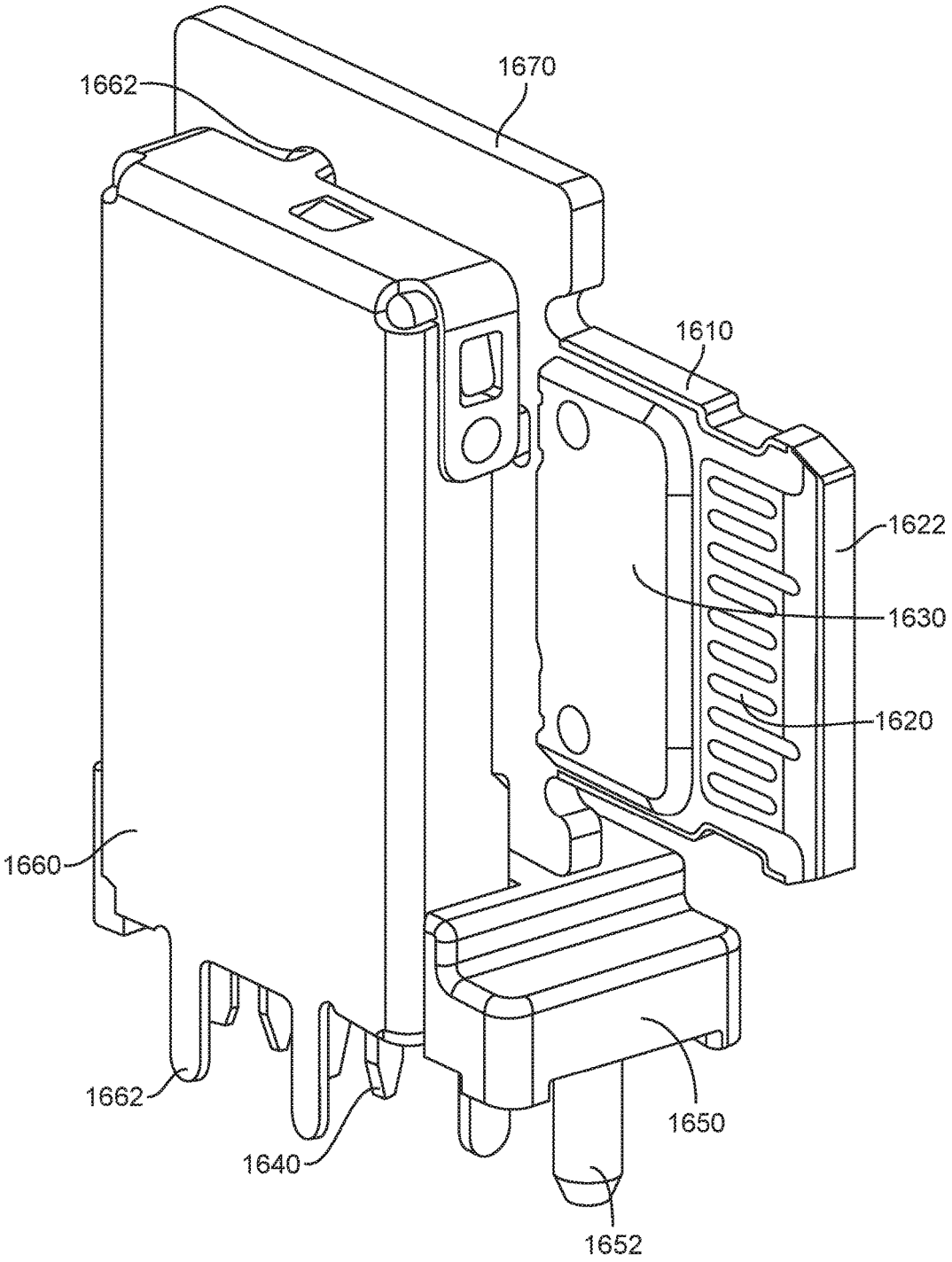
FIG. 16 illustrates an interposer structure according to an embodiment of the present invention.

FIG. 16 illustrates an interposer structure according to an embodiment of the present invention. This figure includes a tongue 1610 supported by a connecting portion 1670. An interposer including housing 1650, shield 1660, and contacts 1640 may mechanically support connecting portion 1670.

Tongue 1610 may support a number of contacts 1620. Contacts 1620 may be plated on surfaces of tongue 1610. Tongue 1610 may also include a front ground plated region 1622. Ground contacts 1630 may be placed on a top and bottom side of tongue 1610. Tongue 1610 and connecting portion 1650 may be formed of a printed circuit board.

Housing 1650 may reside on a second printed circuit board (tongue 1610 and connecting portion 1670 being the first printed circuit board), such as a main logic board (not shown.) Posts 1652 may be inserted into openings in the second printed circuit board. Tabs 1662 and contact tails of contacts 1640 may also be inserted into openings holes in the second printed circuit board. Tabs 1662 may connect to a ground plane or traces supported by the second printed circuit board. Contact tails of contacts 1640 may connect to traces, power, or ground on the second printed circuit board. Shield 1660 may substantially cover a rear, top, and left and right sides of housing 1650.

Figure 17:
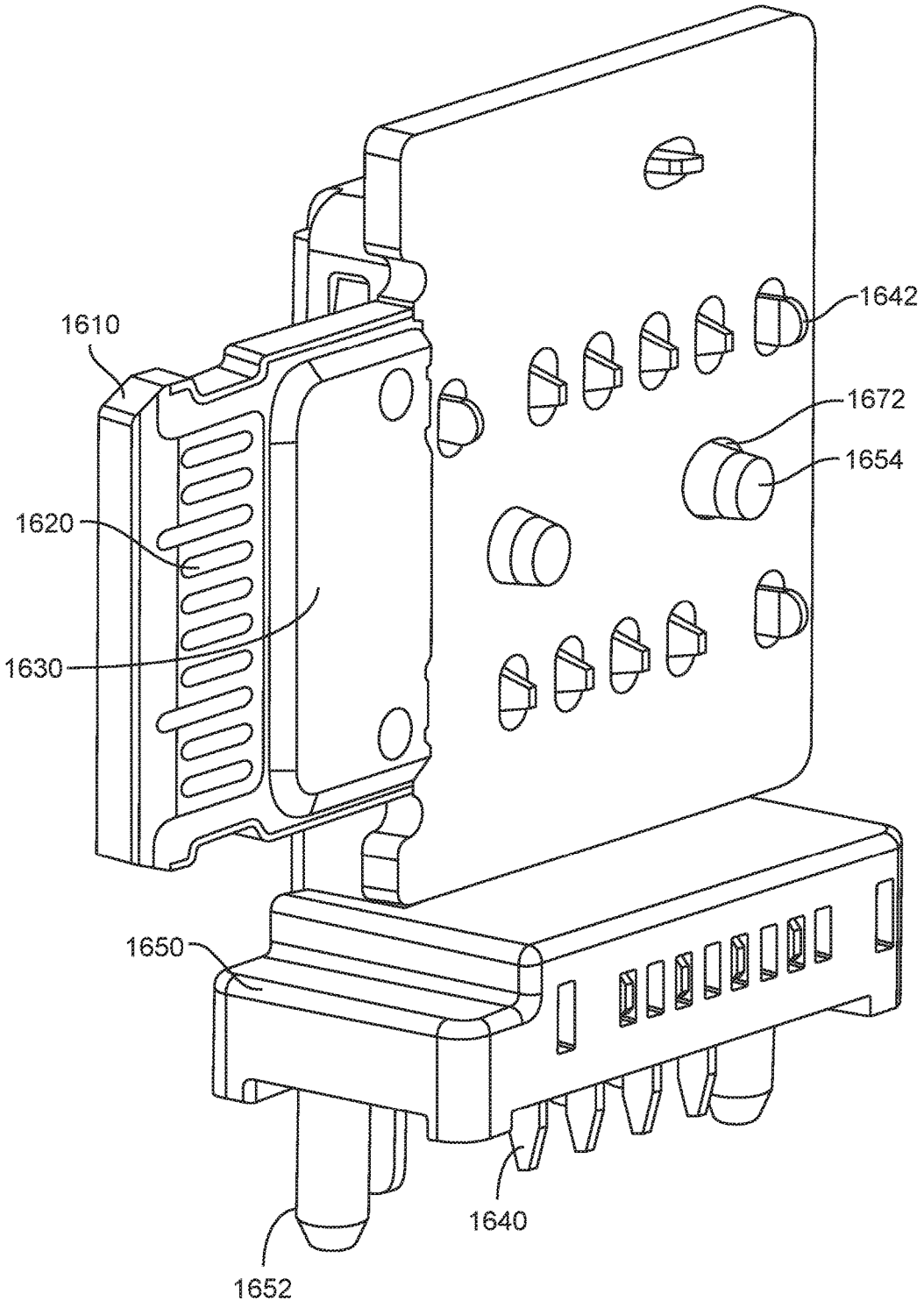
FIG. 17 illustrates a rear view of the interposer structure of FIG. 16.

FIG. 17 illustrates a rear view of the interposer structure of FIG. 16. As before, tongue 1610 may be supported by contacting portion 1670. Housing 1650 may include posts 1654 to fit in openings 1652 of connecting portion 1670 for mechanical support. Posts 1652 of housing 1650 may fit in openings in a second printed circuit board for mechanical stability. In this way, housing 1650 may mechanically secure tongue 1610 and connecting portion 1650 to a second printed circuit board (not shown.)

Contacts 1620 may be electrically connected to traces in, on, or otherwise supported by, tongue 1610 and connecting portion 1670. These traces may connect to through-hole contact portions 1642 of contacts 1640. Contacts 1640 may emerge from a bottom of housing 1650 to form electrical connections with traces in a second printed circuit board.

Figure 18:
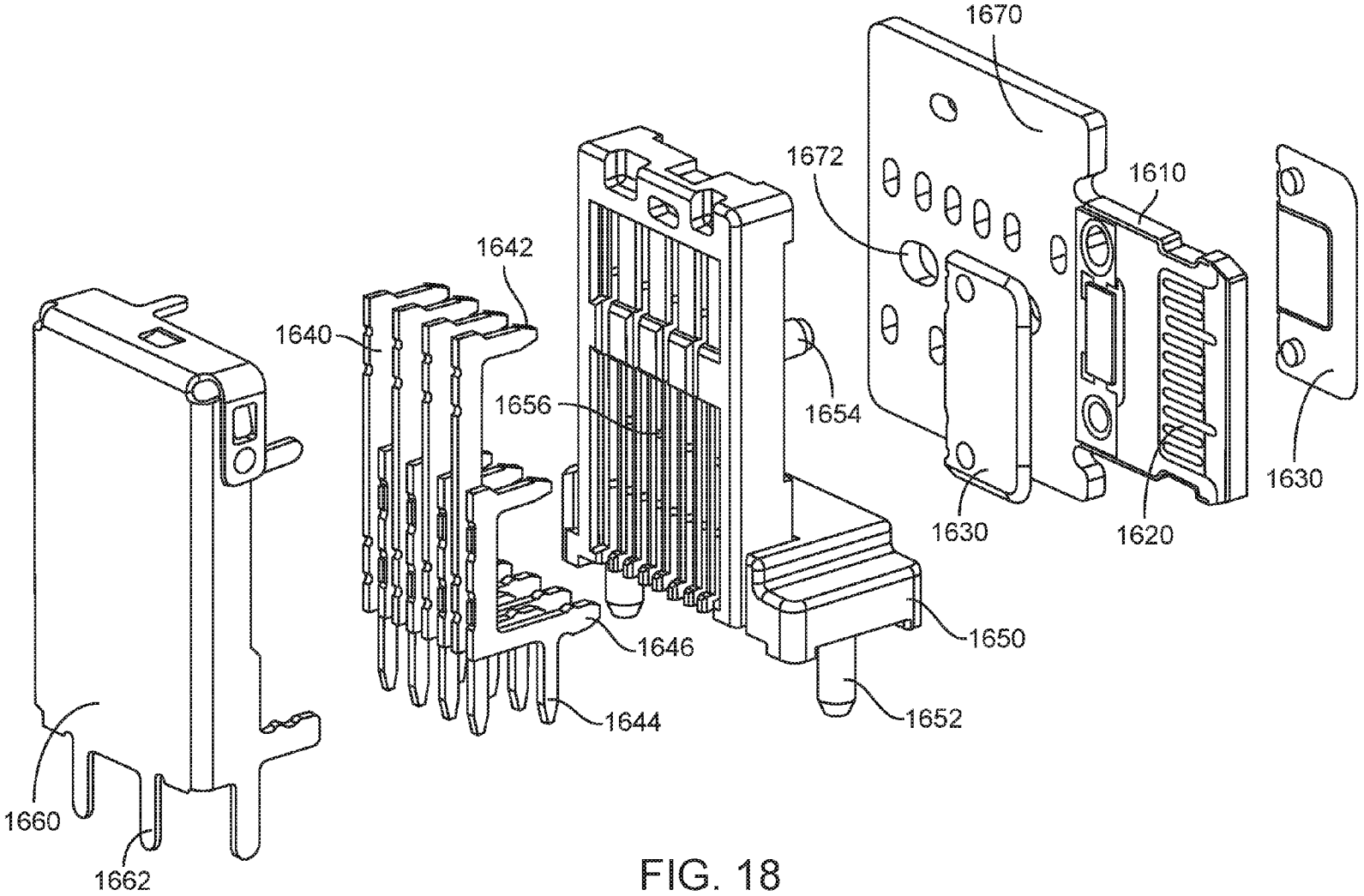
FIG. 18 illustrates an exploded view of the interposer structure of FIG. 16.

FIG. 18 illustrates an exploded view of the interposer structure of FIG. 16. Again, tongue 1610 may be supported by connecting portion 1670. Ground contacts 1630 may be attached to top and bottom side of tongue 1610. Housing 1650 may include posts 1652 for fitting in openings in a second printed circuit board. Housing 1650 may further include posts 1654 for fitting in openings 1672 in connecting portion 1670. Housing 1650 may further include vertical slots 1656. Contacts 1640 may be arranged to fit in vertical slots 1656. Contacts 1640 may include through-hole portions 1642 for fitting in openings to connect to traces in contacting portion 1670. Contacts 1640 may further include through-hole portions 1644 for fitting in openings in a second printed circuit board and forming electrical connections with traces supported by the second printed circuit board. Contacts 1640 may further include front test points 1646, which may be available at front openings on a bottom portion of housing 1650 for testing and other purposes. For example, a flexible circuit board, ribbon cable, or other interconnect may connect to front test points 1646. Shield 1640 may substantially cover a rear, top, and left and right sides of housing 1650.

Figure 19:
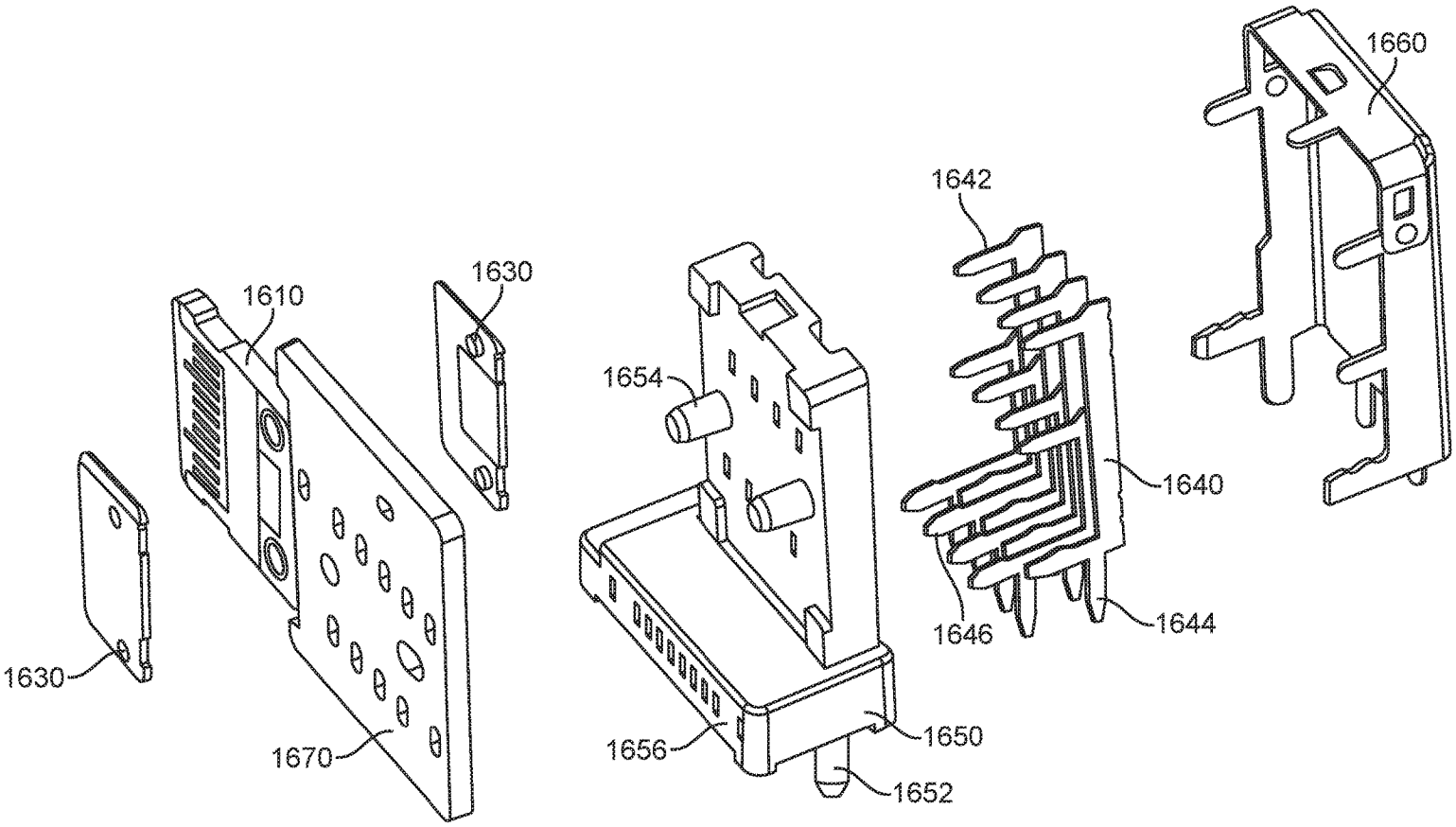
FIG. 19 illustrates another exploded view of the interposer structure of FIG. 16.

FIG. 19 illustrates another exploded view of the interposer structure of FIG. 16. Again, tongue 1610 may be supported by connecting portion 1670. Housing 1650 may include posts 1654 to fit in openings 1672 on connecting portion 1670. Ground contacts 1630 may be located on a top and bottom of tongue 1610. The ground contacts 1630 may be attached to tongue 1610 by spot or laser welding, soldering, or other method. Contacts 1640 may include through-hole portions 1642 for making electrical connections with traces supported by connecting portion 1670. These traces may electrically connect to contacts 1620 on tongue 1610. Contacts 1640 may include through-hole portions 1644 for forming electrical connections with traces supported by the printed circuit board. Contacts 1640 may further include front test portions 1646, which may be electrically accessible at openings 1656 of housing 1650 for testing or other purposes. For example, a flexible circuit board, ribbon cable or other interconnecting structure may be attached at these contacting points. Shield 1660 may substantially cover a rear, top, and left and right sides of housing 1650.

Figure 20:
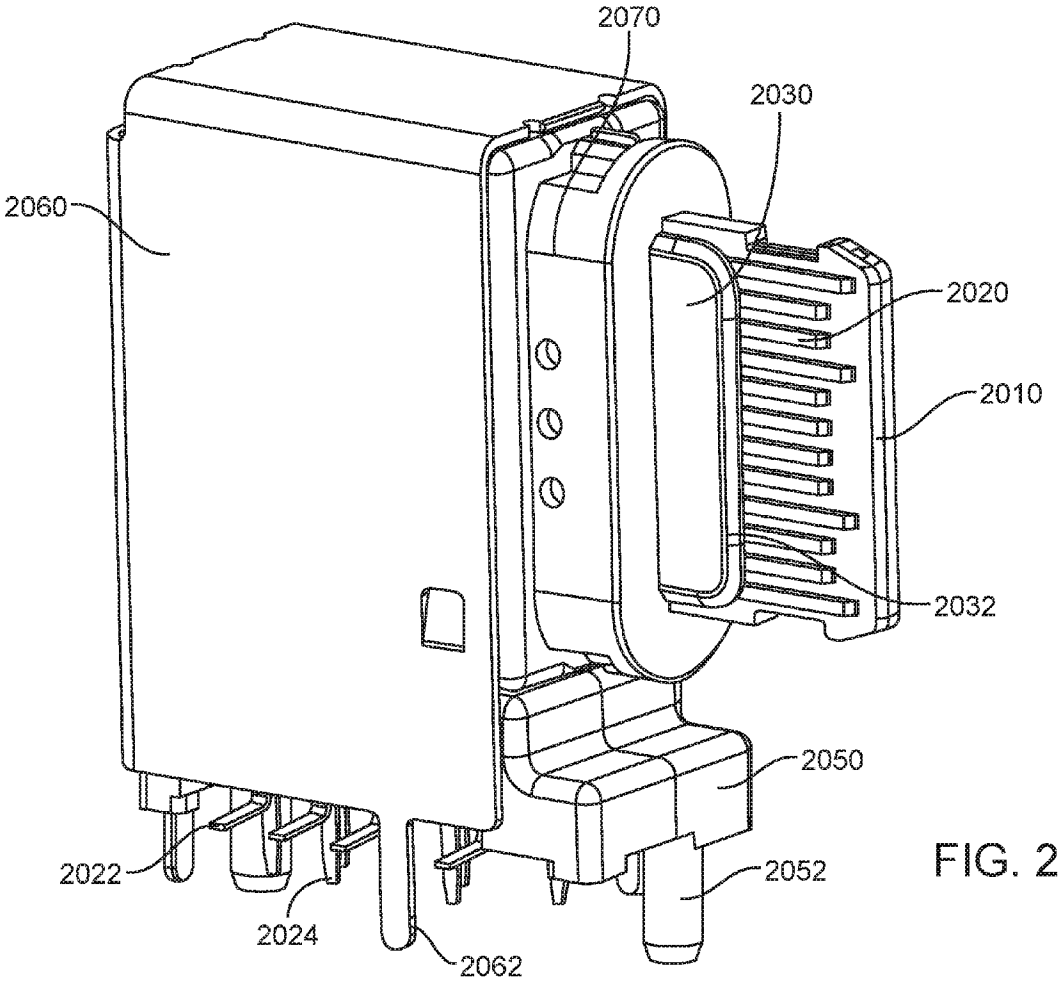
FIG. 20 illustrates another interposer structure according to an embodiment of the present invention.

FIG. 20 illustrates another interposer structure according to an embodiment of the present invention. In this example, tongue 2010 may be attached to housing 2050 via connecting structure 2070. Tongue 2010 may support a number of contacts 2020. Contacts 2020 may emerge from a bottom of interposer structure as surface-mount contacting portion 2022 or through-hole contacting portions 2024. Tongue 2010 may further support ground contacts 2030. Ground contacts 2030 may be isolated from contacts 2020 by portion 2032. Housing 2050 may include posts 2052. Posts 2052 may fit in openings in a printed circuit board, such as a main logic board, for mechanical stability. Shield 2060 may substantially covered a rear, top, and left and right sides of housing 2050. Shield 2060 may include tabs 2062. Tabs 2062 may fit in openings in a printed circuit board for grounding.

Figure 21:
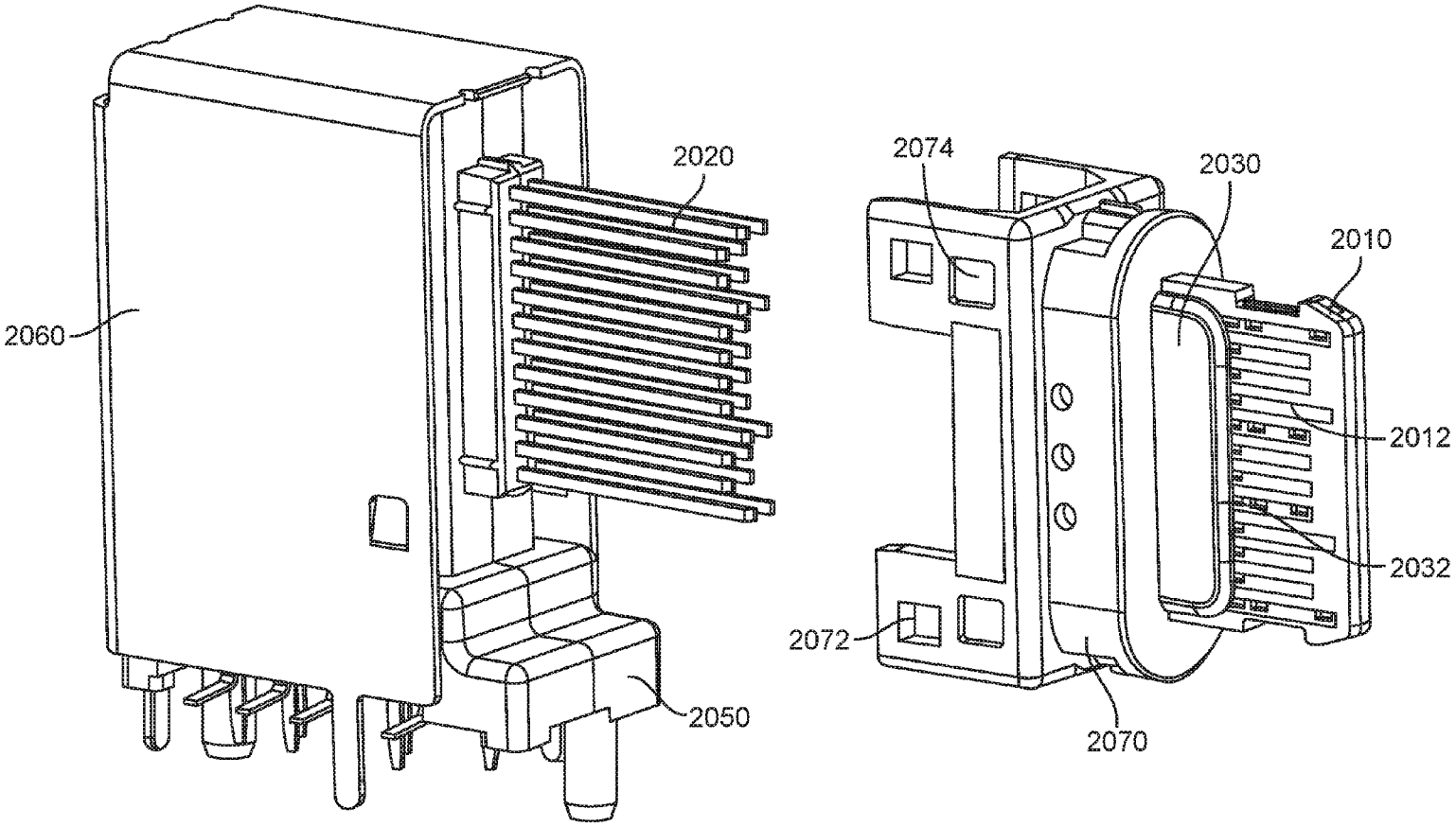
FIG. 21 illustrates a partially exploded view of the interposer structure of FIG. 20.

FIG. 21 illustrates a partially exploded view of the interposer structure of FIG. 20. A plurality of contacts 2020 may emerge from housing 2050. Shield 2060 may substantially cover a rear, top and left and right sides of housing 2050. Connecting portion 2070 may support tongue 2010. Tongue 2010 may include a number of slots 2012 where contacts 2020 may be located. Tongue 2010 may include ground contacts 2030, which may be isolated from contacts 2020 by portion 2032.

Figure 22:
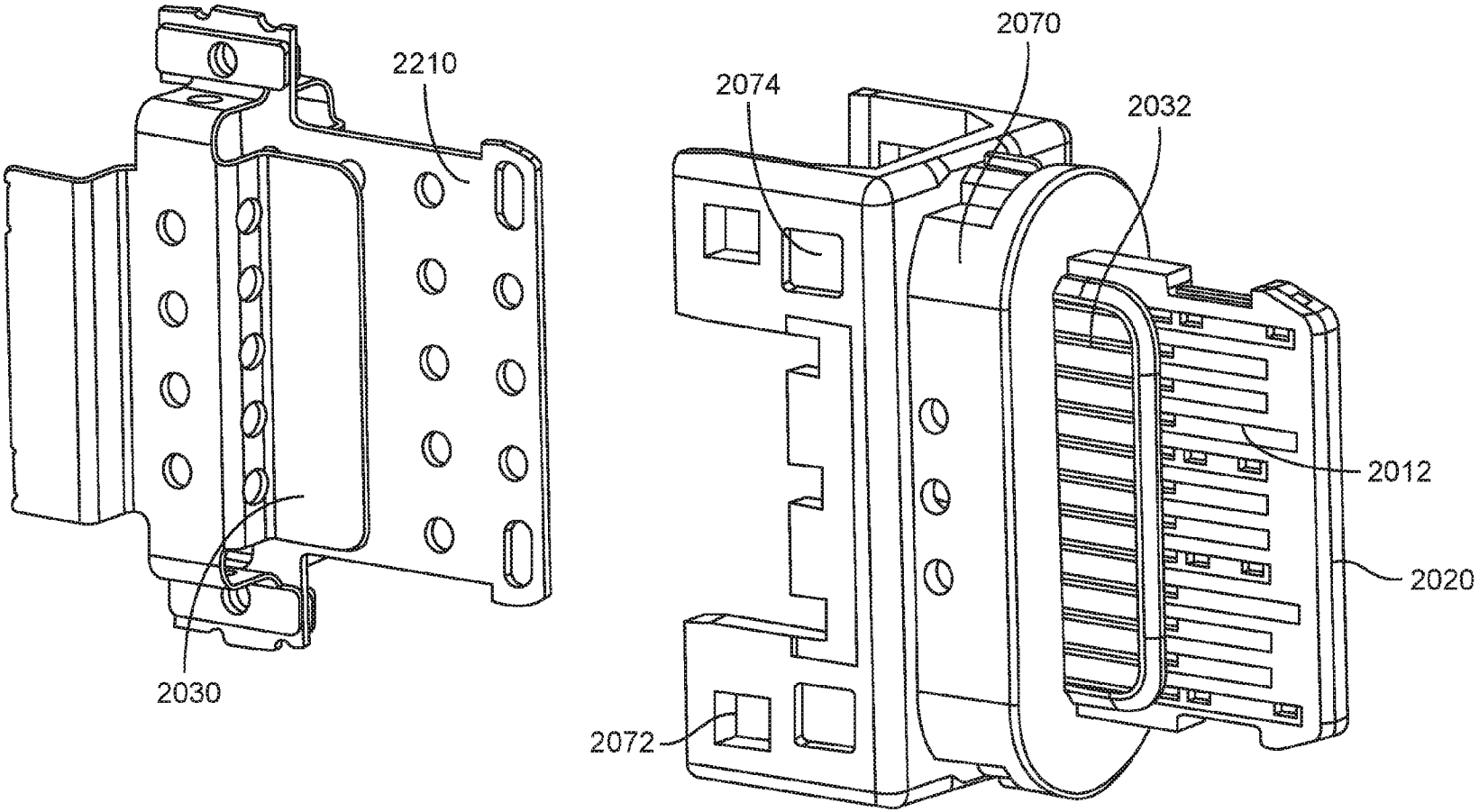
FIG. 22 illustrates a partially exploded view of the interposer structure of FIG. 20.

FIG. 22 illustrates an exploded view of a tongue for the interposer structure of FIG. 20. Tongue 2010 may include a central ground plane 2210. Central ground plane 2210 may be formed by metallic injection molding, stamping, forging, or other process. Central ground plane 2210 may be formed of stainless steel or other conductive material. Central ground plane 2210 may include ground contacts 2030. Tongue 2010 may include portion 2032 for isolating ground contacts 2030 from contacts 2020. Tongue 2010 may also include slots 2012 for accepting contacts 2020.

Tongue 2010 may be formed in various ways. For example, tongue 2010 may be insert molded around central ground plane 2010. Contacts 2020 may later be inserted into the structure including tongue 2010. In other embodiments of the present invention, tongue 2010 may be insert molded around contacts 2020 and central ground plane 2210. In still other embodiments of the present invention, tongue 2010 may be formed, and contacts 2020 and central ground plane 2210 may later be fit into the structure.

Figure 23:
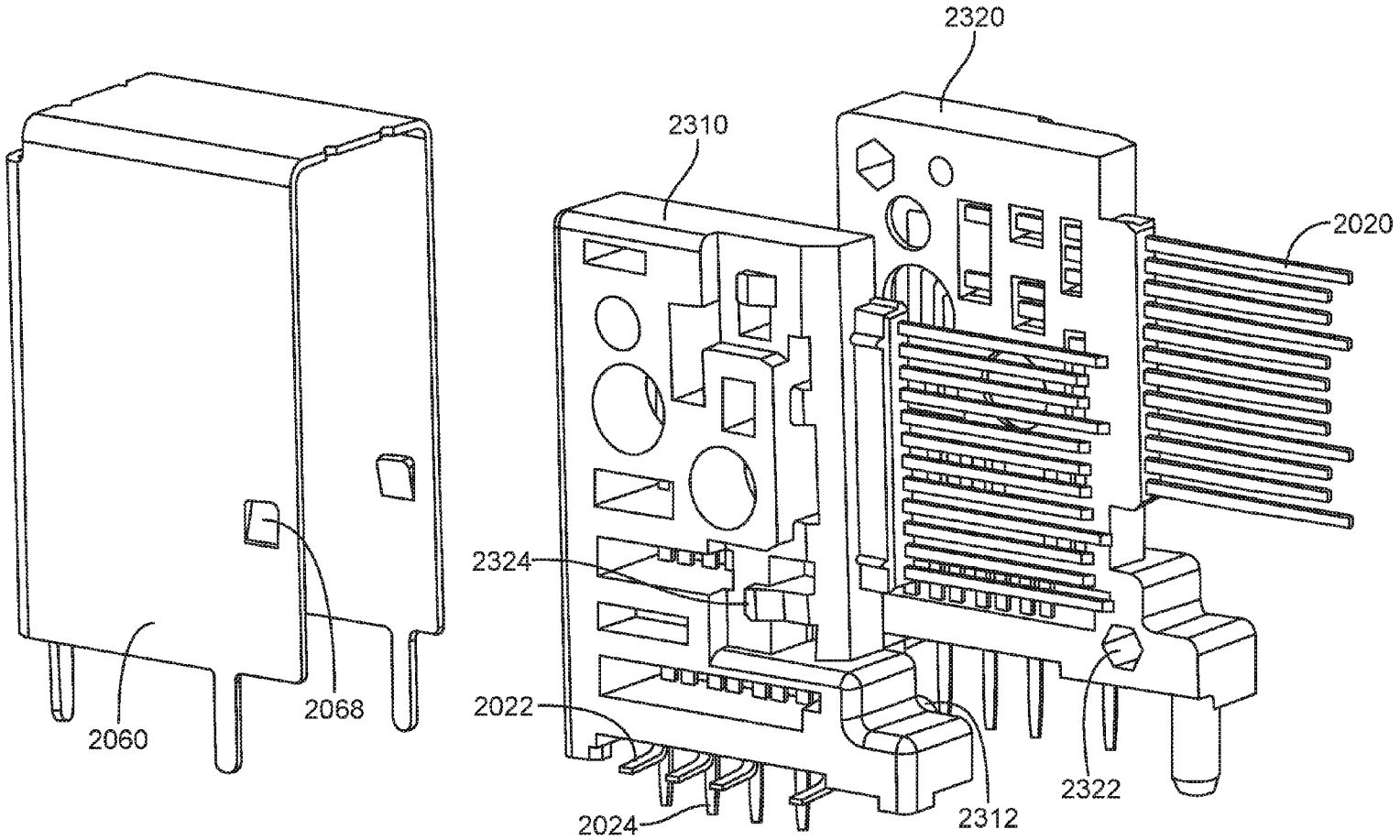
FIG. 23 illustrates a partially exploded view of the interposer structure of FIG. 20.

FIG. 23 illustrates an exploded view of a housing and shield for the interposer structure of FIG. 20. In this example, housing 2050 may be formed of two housing portions 2310 and 2320. Housing portions 2310 and 2320 may support a number of contacts 2020. Contacts 2020 may emerge on a bottom of the interposer structure as surface-mount contacts portions 2022 or as through-hole contact portions 2024. Tabs 2312 on housing portion 2310 may be arranged to fit in openings 2322 on housing portion 2320 to secure housing portion 2310 to housing portion 2320. Shield 2060 may be slid over a top of housing portions 2310 and 2320 once they are attached. Housing portions 2310 and 2320 may be insert molded around contacts 2020.

During assembly, openings 2072 on connecting portion 2070 may fit over tabs 2324 to secure connecting portion 2070 to housing 2050, which again may be made up of housing portions 2310 and 2320. Tabs 2068 on shield 2060 may fit in cutouts 2074 on connecting portion 2070 to hold shield 2060 in place.

In various embodiments of the present invention, contacts, shields, and other conductive portions of interposers and other connecting structures may be formed by stamping, metal-injection molding, machining, micro-machining, 3-D printing, or other manufacturing process. The conductive portions may be formed of stainless steel, steel, copper, copper titanium, phosphor bronze, or other material or combination of materials. They may be plated or coated with nickel, gold, or other material. The nonconductive portions, such as the housings and device enclosures, may be formed using injection or other molding, 3-D printing, machining, or other manufacturing process. The nonconductive portions may be formed of silicon or silicone, rubber, hard rubber, plastic, nylon, liquid-crystal polymers (LCPs), or other nonconductive material or combination of materials. The printed circuit boards and tongues used may be formed of FR-4, BT or other material. Printed circuit boards may be replaced by other substrates, such as flexible circuit boards, in many embodiments of the present invention.

Embodiments of the present invention may provide interposes and connecting structures that may be located in, and may connect to, various types of devices, such as portable computing devices, tablet computers, desktop computers, laptops, all-in-one computers, wearable computing devices, cell phones, smart phones, media phones, storage devices, portable media players, navigation systems, monitors, power supplies, adapters, remote control devices, chargers, and other devices. These interposes and connecting structures may provide pathways for signals that are compliant with various standards such as Universal Serial Bus (USB) including USB-C, High-Definition Multimedia Interface (HDMI), Digital Visual Interface (DVI), Ethernet, DisplayPort, Thunderbolt, Lightning, Joint Test Action Group (JTAG), test-access-port (TAP), Directed Automated Random Testing (DART), universal asynchronous receiver/transmitters (UARTs), clock signals, power signals, and other types of standard, non-standard, and proprietary interfaces and combinations thereof that have been developed, are being developed, or will be developed in the future. Other embodiments of the present invention may provide interposes and connecting structures that may be used to provide a reduced set of functions for one or more of these standards. In various embodiments of the present invention, these interconnect paths provided by these interposes and connecting structures may be used to convey power, ground, signals, test points, and other voltage, current, data, or other information.

The above description of embodiments of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications to thereby enable others skilled in the art to best utilize the invention in various embodiments and with various modifications as are suited to the particular use contemplated. Thus, it will be appreciated that the invention is intended to cover all modifications and equivalents within the scope of the following claims.

What is claimed is:

1. An electronic device comprising:

a device enclosure having a connector receptacle, the connector receptacle comprising:

a recess in the device enclosure, the recess having an opening in a rear surface; and a tongue supporting contacting portions of a first plurality of contacts on a first side of the tongue and contacting portions of a second plurality of contacts on a second side of the tongue, the tongue extending through the opening in the rear surface of the recess, wherein the tongue is a portion of an interposer, the interposer further comprising:

a first housing formed around the first plurality of contacts, where each of the first plurality of contacts includes a contacting portion at a first end and a contact tail at a second end;

a second housing formed around the second plurality of contacts, where each of the second plurality of contacts includes a contacting portion at a first end and a contact tail at a second end; and a third housing including the tongue supported by a connecting portion, wherein a first tab on the first housing fits in a first opening in the second housing, a second tab on the first housing fits in a second opening in the connecting portion of the third housing, and a third tab on the second housing fits in a third opening on the connecting portion of the third housing to secure the first housing, the second housing, and the third housing together.

2. The electronic device of claim 1 wherein the connector receptacle consists of the recess in the device enclosure of the electronic device, the tongue, and contacts supported by the tongue, the contacts including the first plurality of contacts and the second plurality of contacts.

3. The electronic device of claim 1 further comprising a printed circuit board, wherein contact tails for each of the first plurality of contacts and each of the second plurality of contacts are attached to the printed circuit board.

4. The electronic device of claim 3 wherein the tongue and the printed circuit board are at least approximately orthogonal to each other.

5. The electronic device of claim 4 wherein the tongue is formed of plastic.

6. The electronic device of claim 5 wherein each of the first plurality of contacts and each of the second plurality of contacts further comprise a ninety degree bend.

7. The electronic device of claim 6 wherein the interposer further comprises a shield.

8. The electronic device of claim 7 wherein a first tab on the shield fits in a first cutout of the connecting portion of the third housing and a second tab on the shield fits in a second cutout of the connecting portion of the third housing to secure the shield to the third housing.

9. The electronic device of claim 1 wherein contact tails of the first plurality of contacts form a first row of surface mount contact tails and a second row of through-hole contact tails, where the first row is along an outside edge of the interposer.

10. An electronic device comprising:

a device enclosure having a connector receptacle, the connector receptacle comprising:

a recess in the device enclosure, the recess having an opening in a rear surface; and a tongue supporting contacting portions of a first plurality of contacts on a first side of the tongue and contacting portions of a second plurality of contacts on a second side of the tongue, the tongue extending through the opening in the rear surface of the recess, wherein the tongue is a portion of an interposer, the interposer further comprising:

a first housing formed around the first plurality of contacts, where each of the first plurality of contacts includes a contacting portion at a first end and a contact tail at a second end;

a second housing attached to the first housing and formed around the second plurality of contacts, where each of the second plurality of contacts includes a contacting portion at a first end and a contact tail at a second end;

a third housing attached to the first housing and the second housing and including the tongue supported by a connecting portion; and a central ground plane forming a central ground plane portion in a center of the tongue, a first ground contact on the first side of the tongue, and a second ground contact on the second side of the tongue.

11. The electronic device of claim 10 wherein the tongue is formed of plastic and the central ground plane is formed of metal.

12. The electronic device of claim 11 wherein each of the first plurality of contacts and each of the second plurality of contacts further include a ninety-degree angle.

13. The electronic device of claim 12 further comprising a printed circuit board, wherein contact tails for each of the first plurality of contacts and each of the second plurality of contacts are attached to the printed circuit board.

14. The electronic device of claim 13 wherein one of the first plurality of contacts has a through-hole tail portion one of the first plurality of contacts has a surface-mount tail portion.

15. The electronic device of claim 14 wherein the interposer further comprises a shield substantially around a top, rear, and two sides of the attached first and second housing.

16. An interposer the interposer comprising:

a first plurality of contacts having contacting portions at a first end and a contact tail at a second end;

a second plurality of contacts having contacting portions at a first end and a contact tail at a second end;

a tongue supporting the contacting portions of the first plurality of contacts and the contacting portions of the second plurality of contacts;

a first housing formed around the first plurality of contacts,;

a second housing formed around the second plurality of contacts; and a third housing including the tongue supported by a connecting portion, wherein a first tab on the first housing fits in a first opening in the second housing, a second tab on the first housing fits in a second opening in the connecting portion of the third housing, and a third tab on the second housing fits in a third opening on the connecting portion of the third housing to secure the first housing, the second housing, and the third housing together.

17. The interposer of claim 16 wherein each of the first plurality of contacts and each of the second plurality of contacts further include a ninety-degree angle.

18. The interposer of claim 17 further comprising a printed circuit board, wherein the contact tails for each of the first plurality of contacts and each of the second plurality of contacts are attached to the printed circuit board, wherein one of the first plurality of contacts has a through-hole tail portion one of the first plurality of contacts has a surface-mount tail portion.

19. The interposer of claim 16 further comprising a shield, wherein a first tab on the shield fits in a first cutout of the connecting portion of the third housing and a second tab on the shield fits in a second cutout of the connecting portion of the third housing to secure the shield to the third housing.

20. The interposer of claim 16 wherein the contact tails of the first plurality of contacts form a first row of surface mount contact tails and a second row of through-hole contact tails, where the first row is along an outside edge of the interposer.

* * * * *